US009498957B2

(12) United States Patent
Tokimatsu et al.

(10) Patent No.: US 9,498,957 B2
(45) Date of Patent: Nov. 22, 2016

(54) INKJET RECORDING APPARATUS AND RECORDING HEAD MAINTENANCE METHOD

(71) Applicant: KONICA MINOLTA INC., Chiyoda-ku (JP)

(72) Inventors: Hiroyuki Tokimatsu, Hino (JP); Mitsuru Obata, Sagamihara (JP); Shinya Takahashi, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/892,481

(22) PCT Filed: May 15, 2014

(86) PCT No.: PCT/JP2014/062968
§ 371 (c)(1),
(2) Date: Nov. 19, 2015

(87) PCT Pub. No.: WO2014/188955
PCT Pub. Date: Nov. 27, 2014

(65) Prior Publication Data

US 2016/0101625 A1 Apr. 14, 2016

(30) Foreign Application Priority Data

May 20, 2013 (JP) ..... 2013-106162

(51) Int. Cl.
*B41J 2/165* (2006.01)
*B41J 2/175* (2006.01)

(52) U.S. Cl.
CPC ..... *B41J 2/16517* (2013.01); *B41J 2/165* (2013.01); *B41J 2/1652* (2013.01); *B41J 2/17596* (2013.01)

(58) Field of Classification Search
None
See application file for complete search history.

(56) References Cited

U.S. PATENT DOCUMENTS

2010/0039460 A1* 2/2010 Delueg ..... B41J 2/1707 347/7
2012/0302658 A1* 11/2012 Vanbesien ..... C09D 11/101 522/36
2014/0198153 A1* 7/2014 Nakanishi ..... B41J 2/16508 347/30

FOREIGN PATENT DOCUMENTS

| | | |
|---|---|---|
| CN | 102001226 | 4/2011 |
| CN | 102796418 | 11/2012 |
| JP | 02-000520 | 1/1990 |
| JP | 10-315491 | 12/1998 |

(Continued)

*Primary Examiner* — Bradley Thies
(74) *Attorney, Agent, or Firm* — Cozen O'Connor

(57) ABSTRACT

Inkjet recording apparatus includes recording head 241 having a plurality of nozzles N, first ink storage section 242, supply passage 301 connecting recording head 241 and section 242, electromagnetic valve 310 that opens or closes section 242, second ink storage section 243, pump P1 that supplies the ink in section 243 to section 242, an electromagnetic valve 312 that opens or closes the second storage ink section 243, recovery passage 302 that connects the recording head 241 and the second storage section 243, and electromagnetic valves 307 and 308 which open or close the recovery passage 302. Control unit 40 allows ink inside the recording head 241 to reflow to the second ink storage section 243 by operating the pump P1 in a state in which the electromagnetic valves 310 and 312 are closed and the electromagnetic valve 308 is opened.

11 Claims, 17 Drawing Sheets

(56) References Cited

FOREIGN PATENT DOCUMENTS

| | | | | |
|---|---|---|---|---|
| JP | 2005-53047 | | | 3/2005 |
| JP | 2006-116955 | | | 5/2006 |
| JP | 2011-51171 | | | 3/2011 |
| JP | 2011-56784 | | | 3/2011 |
| JP | 2011051171 | A | * | 3/2011 |
| JP | 2011-206954 | | | 10/2011 |
| JP | 2012-61768 | | | 3/2012 |
| JP | 2012-246478 | | | 12/2012 |

* cited by examiner

INKJET RECORDING APPARATUS AND RECORDING HEAD MAINTENANCE METHOD

RELATED APPLICATIONS

This is a U.S. National stage of International application No. PCT/JP2014/062968 filed on May 15, 2014.

This patent application claims the priority of Japanese application no. 2013-106162 filed May 20, 2013 the disclosure content of which is hereby incorporated by reference.

TECHNICAL FIELD

The present invention relates to an inkjet recording apparatus, and a recording head maintenance method.

BACKGROUND ART

In the inkjet recording apparatus, when clogging occurs in a nozzle of the recording head that ejects ink, or air bubbles are mixed into ink before ejection in the vicinity of the nozzle, ejection of the ink from the nozzle may be hindered, and thus a failure may occur during image formation in some cases. Here, in order to solve the clogging of the nozzle or in order to remove the air bubbles in the ink, there is known an inkjet recording apparatus having a function of carrying out maintenance such as pressure purge in which a pressure is applied to the nozzle so as to eject the ink from the nozzle, and suction purge in which the ink is suctioned from the nozzle by using an air-intake unit (for example, Patent Literature 1 and 2).

In addition, as one kind of the maintenance that is carried out in the inkjet recording apparatus, there is known maintenance (reflow maintenance) in which ink transported to the recording head is allowed to reflow to a storage section that is an ink feeding source so as to remove air bubbles mixed into the ink inside the recording head. In a recording head to which the reflow maintenance is applicable, a recovery passage, through which the ink inside the recording head is recovered to the storage section, is provided separately from a supply passage through which the ink is fed.

CITATION LIST

Patent Literature

Patent Literature 1: JP 2-520 A
Patent Literature 2: JP 2006-116955 A

SUMMARY OF INVENTION

Technical Problem

However, in the reflow maintenance of the related art, a force for guiding ink inside the recording head to the recovery passage depends only on a pressure for feeding ink from the supply passage to the recording head. The pressure becomes a force for extruding the ink inside the recording head to the outside, and thus a part of the force becomes a force for extruding the ink inside the recording head to the recovery passage side, and acts as a force for ejecting the ink from the recording head nozzle. Accordingly, apart of the pressure for carrying out the reflow maintenance wastefully ejects the ink from the nozzle, and thus it is difficult to effectively generate a force for guiding the ink to the recovery passage. In addition, the ink that has been ejected is discarded, and thus in the reflow maintenance of the related art, the ink is wastefully wasted at the time of the reflow maintenance.

An object of the invention is to provide an inkjet recording apparatus capable of reducing the amount of ink to be ejected and carrying out more effective reflow maintenance, and a recording head maintenance method.

Solution to Problem

An inkjet recording apparatus according to an aspect of the disclosed embodiments includes: a recording head that includes a plurality of nozzles through which ink is ejected to a recording medium to form an image; a first storage section that stores ink to be supplied to the recording head; a supply passage which is provided to connect the recording head and the first storage section, and through which ink supplied from the first storage section to the recording head passes; a first switching unit that switches opening or shut-off of gas entrance and exit with respect to the inside of the first storage section; a second storage section that stores ink to be supplied to the first storage section; a supply unit that supplies the ink stored in the second storage section to the first storage section; a second switching unit that switches opening or shut-off of gas entrance and exit with respect to the inside of the second storage section; a recovery passage which is provided to connect the recording head and the second storage section, and through which a part of the ink supplied to the recording head passes and is returned to the second storage section; a third switching unit that switches opening and closing of the recovery passage; and a control unit that controls operation of the first switching unit, the second switching unit, the third switching unit, and the supply unit, wherein the control unit carries out first control of shutting off the gas entrance and exit with respect to the inside of the second storage section by using the second switching unit, shutting off the gas entrance and exit with respect to the inside of the first storage section by using the first switching unit, opening the recovery passage by using the third switching unit, supplying the ink stored in the second storage section to the first storage section by using the supply unit, and allowing ink inside the recording head to reflow to the second storage section.

Embodiments disclosed herein provide an inkjet recording apparatus, as described above, wherein the control unit carries out the first control by opening the recovery passage by using the third switching unit after carrying out second control of supplying the ink stored in the second storage section to the first storage section by using the supply unit, and ejecting the ink from the plurality of nozzles of the recording head in a state in which the gas entrance and exit with respect to the inside of the second storage section is shut off by the second switching unit, the gas entrance and exit with respect to the inside of the first storage section is shut off by the first switching unit, and the recovery passage is closed by the third switching unit.

Embodiments disclosed herein provide an inkjet recording apparatus, as described above, further including: a pressure control unit that allows the inside of the second storage section to enter a negative pressure state by discharging gas inside the second storage section, wherein the second switching unit is provided to a gas flow passage that is connected to a space outside the second storage section from the second storage section through the pressure control unit, and the control unit opens the gas entrance and exit with respect to the inside of the second storage section by using the second switching unit, and allows the inside of the second storage section to enter the negative pressure state by using the pressure control unit before carrying out the first control.

Embodiments disclosed herein provide an inkjet recording apparatus, as described above, further including: a pressure detection unit that measures a pressure inside the second storage section, wherein the control unit carries out the first control in a case where the pressure inside the second storage section is measured by the pressure detection unit as a pressure equal to or lower than a predetermined pressure.

Embodiments disclosed herein provide an inkjet recording apparatus, as described above, wherein the predetermined pressure is set in a range of −5 [kPa] to −30 [kPa].

Embodiments disclosed herein provide an inkjet recording apparatus, as described above, wherein a phase of the ink is changed between a gel phase or a solid phase and a liquid phase in accordance with a temperature.

Embodiments disclosed herein provide an inkjet recording apparatus, as described above, wherein the plurality of nozzles is provided in a direction perpendicular to a direction, in which the recording head and the recording medium are relatively moved during formation of an image, in a number corresponding to a maximum width of the recording medium.

Embodiments disclosed herein provide an a maintenance method for the recording head in the inkjet recording apparatus according to any one of claims 1 to 7, the method including: a step of shutting off gas entrance and exit with respect to the inside of the second storage section by using the second switching unit; a step of shutting off gas entrance and exit with respect to the inside of the first storage section by using the first switching unit; a step of opening the recovery passage by using the third switching unit; and a step of supplying ink stored in the second storage section to the first storage section by using the supply unit, and allowing ink inside the recording head to reflow to the second storage section.

Advantageous Effects of Invention

According to the invention, it is possible to reduce the amount of ink to be ejected, and to carry out more effective reflow maintenance.

BRIEF DESCRIPTION OF DRAWINGS

FIG. 9 is a view illustrating an example of a structure of a first supply passage, a second supply passage, and the like.

DESCRIPTION OF EMBODIMENTS

Figure 1:
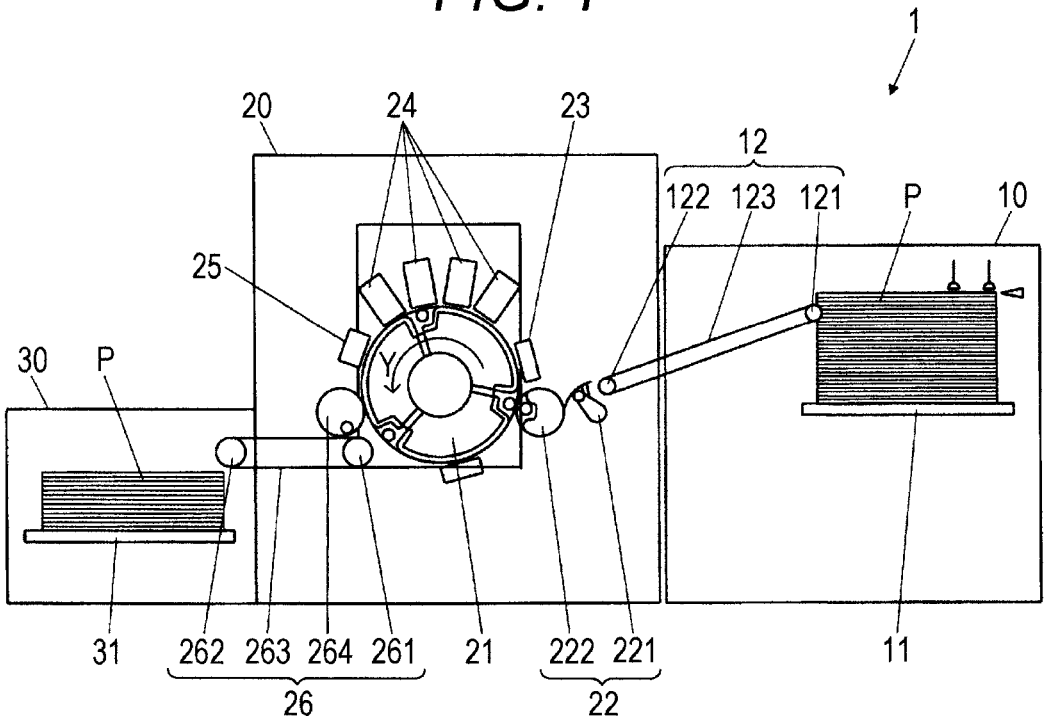
FIG. 1 is a view illustrating a main configuration of an inkjet recording apparatus that is a first embodiment of the invention.

Hereinafter, an embodiment of the invention will be described with reference to the accompanying drawings. However, there are various limitations, which are technically preferable for implementing the invention, on the following embodiment, but the scope of the invention is not limited to the following embodiment and examples illustrated in the drawings.

FIG. 1 is a view illustrating a main configuration of an inkjet recording apparatus 1 that is an embodiment of the invention.

Figure 10:
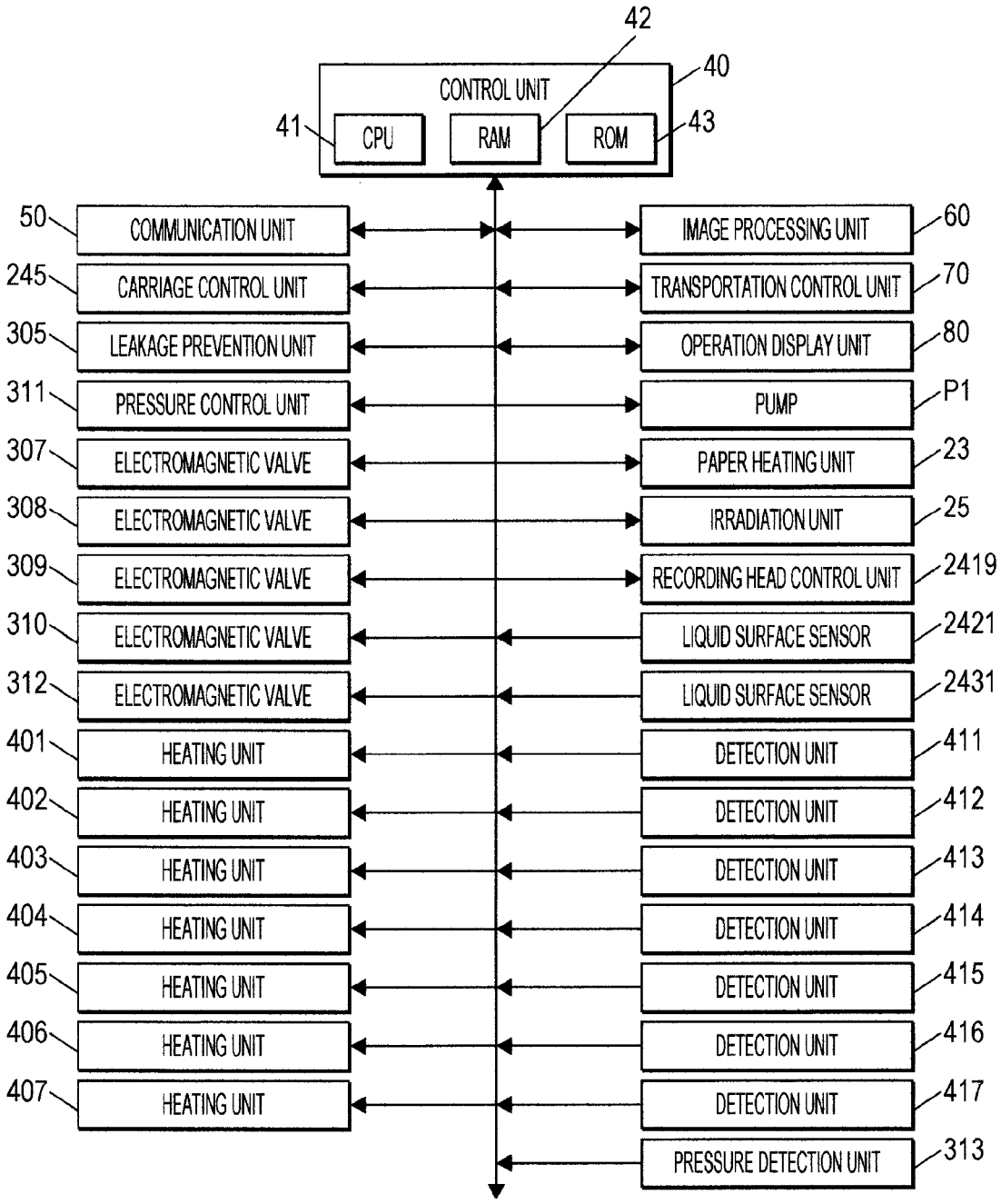
FIG. 10 is a block diagram of the inkjet recording apparatus.

The inkjet recording apparatus 1 includes a paper feeding section 10, an image forming section 20, a paper ejecting section 30, and a control unit 40 (refer to FIG. 10). Under the control of the control unit 40, the inkjet recording apparatus 1 transports a recording medium P that is accommodated in the paper feeding section 10 to the image forming section 20, forms an image on the recording medium P by using the image forming section 20, and discharges the recording medium P on which the image has been formed to the paper ejecting section 30.

The paper feeding section 10 includes a paper feeding tray 11 that stores the recording medium P, and a transporting unit 12 that transports the recording medium P from the paper feeding tray 11 to the image forming section 20.

The paper feeding tray 11 is a plate-shaped member that is provided in such a manner that one or a plurality of recording media P can be placed thereon. The paper feeding tray 11 is provided to vertically move in accordance with the amount of the recording medium P placed on the paper feeding tray 11, and is maintained at a position in the vertical direction where the uppermost recording medium P is transported by the transporting unit 12.

The transporting unit 12 includes a transporting mechanism that drives a ring-shaped belt 123 of which an inner side is carried by a plurality of (for example, two) rollers 121 and 122 to transport the recording medium P on the belt 123, and a supply unit that transports the uppermost recording medium P, which is placed on the paper feeding tray 11, onto the belt 123. The transporting unit 12 transports the recording medium P, which is transported onto the belt 123 by the supply unit, so as to follow the belt 123.

The image forming section 20 includes an image forming drum 21 that carries the recording medium P along a cylindrical outer peripheral surface, a delivering unit 22 that transports the recording medium P, which is transported by the transporting unit 12 of the paper feeding section 10, to the image forming drum 21, a paper heating unit 23 that heats the recording medium P that is carried on the image forming drum 21, a head unit 24 that ejects ink to the recording medium P, which is carried on the image forming drum 21, to form an image, an irradiation unit 25 that irradiates the ink, which is ejected onto the recording medium P, with an energy ray so as to cure the ink, a delivery unit 26 that transports the recording medium P, which is subjected to the irradiation by the irradiation unit 25, from the image forming drum 21 to the paper ejecting section 30, a cleaning unit 27 (refer to FIG. 4) that receives ink, which is ejected from the head unit 24, during maintenance of the head unit 24, and the like.

Figure 2:
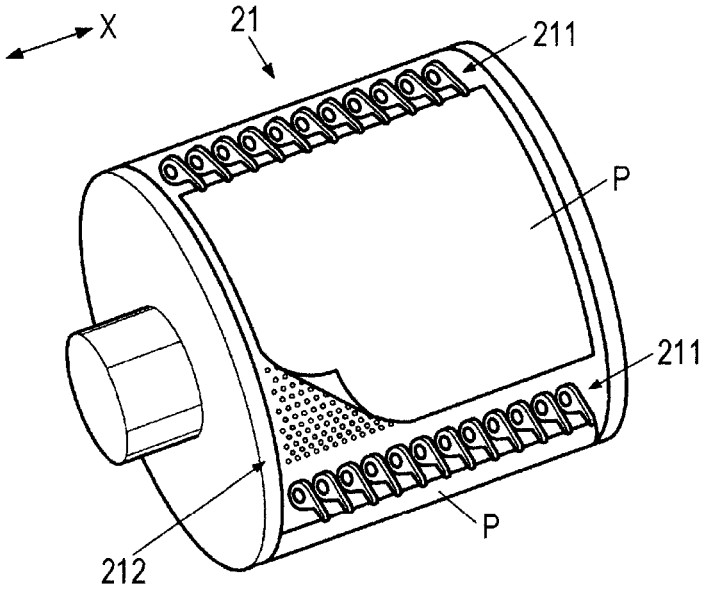
FIG. 2 is a perspective view of an image forming drum.

FIG. 2 is a perspective view of the image forming drum 21.

The image forming drum 21 includes a hook unit 211 and an air-intake unit 212 which are configured to carry the recording medium P on the outer peripheral surface of the image forming drum 21.

As illustrated in FIG. 2, the hook unit 211 includes a plurality of claws provided at predetermined positions on the outer peripheral surface of the image forming drum 21 along a rotary axis direction (X-direction) of the image forming drum 21 having a cylindrical shape. The hook unit 211 carries the recording medium P by nipping one side of the recording medium P in cooperation with the outer peripheral surface of the image forming drum 21.

As illustrated in FIG. 2, the air-intake unit 212 includes a plurality of air-intake holes provided on the outer peripheral surface of the image forming drum 21 that is followed by the recording medium P of which the vicinity of one side is nipped and carried by the hook unit 211, and a suction force generating unit (not illustrated) (for example, an air pump and a fan) which generates a suction force inside the image forming drum 21 so as to suction gas through the air-intake holes. That is, the air-intake unit 212 attracts the recording medium P in order for the recording medium P to follow the outer peripheral surface of the image forming drum 21 by using the suction force generated by air-intake from the air-intake holes.

On the other hand, in FIGS. 2 and 4 to be described later, a part of the recording medium P turns upward from the outer peripheral surface of the image forming drum 21, but this is intended to illustrate the air-intake holes in the drawing, and the entirety of the recording medium P is carried to follow the outer peripheral surface of the image forming drum 21 during image formation by the image forming section 20.

The delivering unit 22 is provided at a position that is interposed between the transporting unit 12 of the paper feeding section 10 and the image forming drum 21. The delivering unit 22 includes a swing arm portion 221 that carries one end of the recording medium P that is transported by the transporting unit 12, a cylindrical delivery drum 222 that transports the recording medium P, which is carried by the swing arm portion 221, to the image forming drum 21, and the like. The delivering unit 22 picks up the recording medium P on the transporting unit 12 by using the swing arm portion 221, and transports the recording medium P to the delivery drum 222. As a result, the delivering unit 22 guides the recording medium P to be appropriate for following the outer peripheral surface of the image forming drum 21, and transports the recording medium P to the image forming drum 21.

The paper heating unit 23 includes an infrared heater and the like, and generates heat in accordance with electrification. The paper heating unit 23 is provided in the vicinity of the outer peripheral surface of the image forming drum 21 to be located upstream of the head unit 24 in a transporting direction Y of the recording medium P by rotation of the image forming drum 21. Heat generation in the paper heating unit 23 is controlled by the control unit 40 in such a manner that the recording medium P, which is carried on the image forming drum 21 and passes through the vicinity of the paper heating unit 23, reaches a predetermined temperature.

In addition, a temperature sensor (not illustrated) is provided in the vicinity of the paper heating unit 23. The control unit 40 controls operation of the paper heating unit 23 based on a temperature measured by the temperature sensor in the vicinity of the paper heating unit 23 in such a manner that the recording medium P, which is carried on the image forming drum 21 and passes through the vicinity of the paper heating unit 23, reaches a predetermined temperature.

Figure 3A:
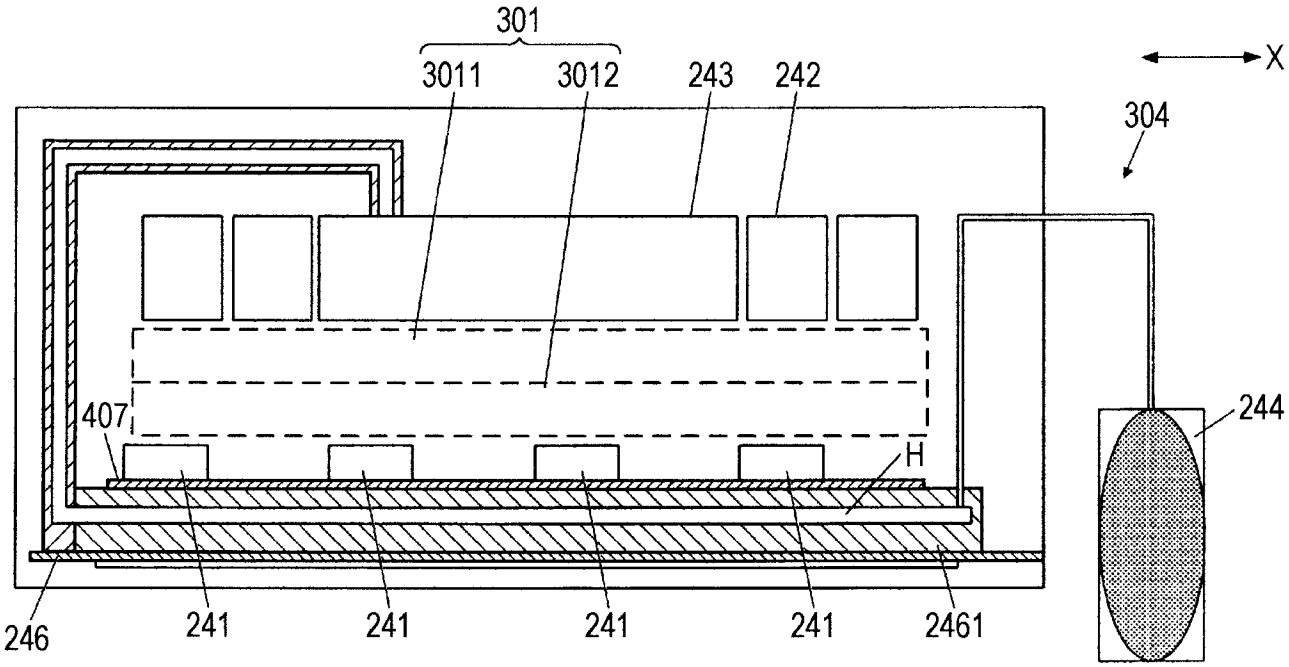
FIG. 3A is a view illustrating an example of a configuration of a head unit, and is a schematic cross-sectional view of an internal configuration of the head unit when viewed from a lateral side.
Figure 3B:
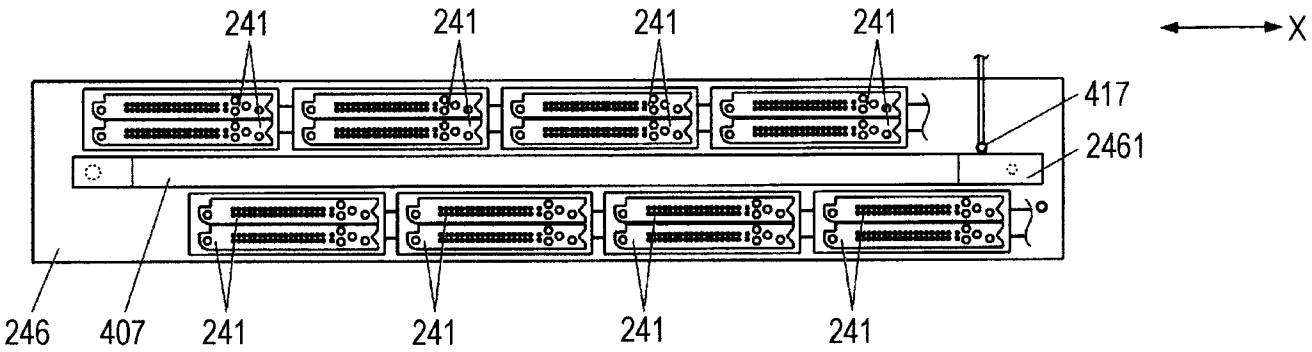
FIG. 3B is a view illustrating an example of a configuration of the head unit, and is a schematic view of an internal configuration of the head unit when viewed from an upper side.

FIGS. 3A and 3B are views illustrating an internal configuration of the head unit 24. FIG. 3A is a schematic cross-sectional view of the internal configuration of the head unit 24 when viewed from a lateral side. FIG. 3B is a schematic view of the internal configuration of the head unit 24 when viewed from an upper side. On the other hand, the upper side described here represents an upper side in a case where one surface (lower surface) side of the head unit 24, which faces the outer peripheral surface of the image forming drum 21, is set as a lower side of the head unit 24. In addition, the term "when viewed from a later side" represents a case where the head unit 24 is viewed in a state in which one surface side viewed in a transporting direction of the recording medium P is set as a front surface.

The head unit 24 is disposed along the outer peripheral surface of the image forming drum 21 with a predetermined distance with respect to the image forming drum 21.

In addition, as illustrated in FIGS. 3A and 3B, the head unit 24 includes a plurality of recording heads 241. The plurality of recording heads 241 is attached to a base portion 246 of the head unit 24.

Figure 7:
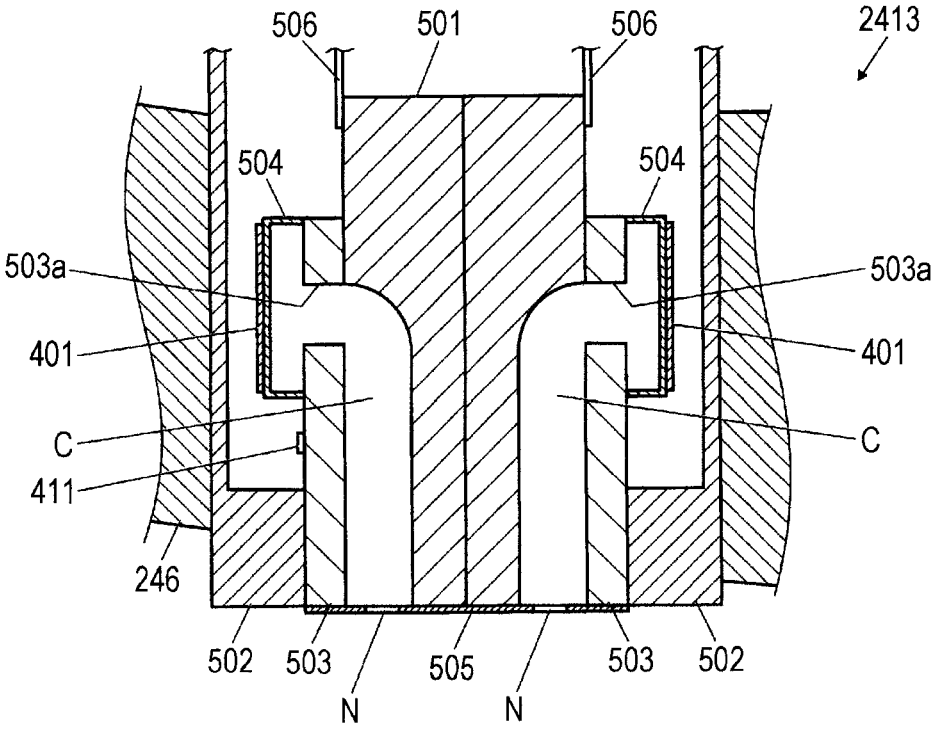
FIG. 7 is a cross-sectional view of a lower flow passage portion along a plane perpendicular to an X-direction.

Each of the recording heads 241 includes a plurality of nozzles N (refer to FIG. 7). The recording head 241 ejects ink from the plurality of nozzles N to form an image on the recording medium P that is carried on the image forming drum 21. That is, the recording head 241 is provided in such a manner that the plurality of nozzles N is exposed to a lower surface side of the head unit. For example, the recording head 241 includes the plurality of nozzle N in which two rows of the nozzles N are provided along the X-direction.

For example, as illustrated in FIG. 3B, the plurality of recording heads 241 is disposed in such a manner that two recording heads 241 are set as one set, and each set of the recording heads 241 constitutes the row of the plurality of recording heads 241 provided along the X-direction. In addition, the recording heads 241 are provided in a plurality of the rows, and are disposed in such a manner that a positional relationship between sets of the recording heads 241 in rows adjacent to each other becomes a zigzag shape in a direction perpendicular to the X-direction.

Figure 4:
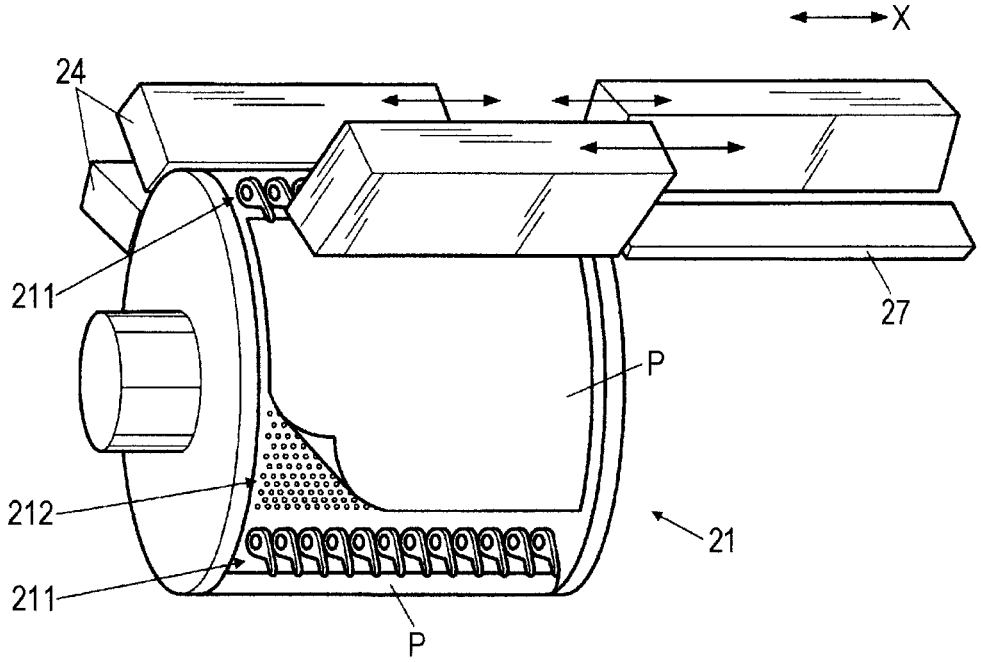
FIG. 4 is a perspective view illustrating a positional relationship between an image forming drum and a cleaning unit, and a position of the head unit before and after movement thereof.

FIG. 4 is a perspective view illustrating a positional relationship between the image forming drum 21 and the cleaning unit 27, and a position of the head unit 24 before and after movement thereof.

The head unit 24 is provided to individually move along the X-direction. Specifically, as illustrated in FIG. 4, the head unit 24 is provided to move along the image forming drum 21 and the cleaning unit 27 which are provided in parallel along the X-direction. Under control of the control unit 40, the head unit 24 moves to a position at which a lower surface thereof faces the image forming drum 21 during image formation, and moves to a position at which the lower surface faces the cleaning unit 27 during various kinds of maintenance to be described later. The movement of the head unit 24 is carried out by a carriage control unit 245 to be described later.

In addition, the head unit 24 is individually provided with respect to respective colors (C, M, Y, and K) which can be used to form an image. In the inkjet recording apparatus 1 illustrated in FIGS. 1 and 4, the head unit 24, which corresponds to each color in the order of colors of Y, M, C, and K from an upstream side, is provided along a transporting direction of the recording medium P that is transported in accordance with rotation of the image forming drum 21.

In addition, as illustrated in FIG. 4, a width of the head unit 24 in the X-direction is set to sufficiently cover a width of the recording medium P, which is carried on and is transported by the image forming drum 21, in the X-direction, and a position of the head unit 24 is fixed with respect to the image forming drum 21 during image formation. That is, the inkjet recording apparatus 1 is a one pass type inkjet recording apparatus. In the head unit 24, the plurality of nozzles N of the plurality of recording heads 241, provided in parallel along the X-direction, is provided in a number that corresponds to a maximum width of the recording medium P in a direction (X-direction) perpendicular to a direction in which the recording heads 241 and the recording medium P relatively move during image formation.

In addition, each of the recording heads 241 includes a heating unit 401.

For example, the heating unit 401 is provided on a lateral surface of a manifold 504, and operates under control of the control unit 40.

Here, description will be given of ink.

Ink, which can be used to form an image by using the inkjet recording apparatus 1, has a property in which a phase thereof is changed between a gel phase or a solid phase and a liquid phase in accordance with a temperature. Here, the liquid phase is a concept including a sol phase.

Specifically, the phase of the ink is changed to be a solid phase (gel phase) or a liquid phase in accordance with a temperature. Examples of a composition of the ink include a composition in which a polymerizable compound and a photopolymerization initiator are included as main components and to which a gelling agent is added in several percentages.

Here, an example of preparing the ink will be disclosed.

First, two kinds of compounds, which include 5 parts of Solsperse 32000 (manufactured by Lubrizol Corporation), and 80 parts of HD-N (1,6-hexanediol dimethacrylate, manufactured by shin-Nakamura Chemical Co., Ltd), are put into a stainless steel beaker, and are dissolved while being heated and stirred. Then, the resultant mixture is cooled down to room temperature, and 15 parts of carbon black (#56, manufactured by Mitsubishi Chemical Corporation) is added to the mixture. The resultant mixture is put into a glass bottle in combination with zirconia beads having a size of 0.5 [mm], and the bottle is hermetically sealed. Then, a dispersion treatment is carried out in a paint shaker for 10 hours. The resultant material, from which the zirconia beads are removed, is obtained as a pigment dispersion.

Compositions including the pigment dispersion obtained as described above are adjusted in a manner similar to an example illustrated in Tables 1 to 6.

TABLE 1

| | Name | Manufacturer | Addition amount (part) |
|---|---|---|---|
| Polymerizable compound | A-600 | Shin-Nakamura Chemical Co., Ltd. | 50 |
| Polymerizable compound | A-GLY-9E | Shin-Nakamura Chemical Co., Ltd. | 5 |
| Polymerizable compound | HD-N | Shin-Nakamura Chemical Co., Ltd. | 4.85 |
| Pigment dispersion | | | 20 |
| Gelling agent | KAO WAX T-1 | Kao Corporation | 5 |
| Photopolymerization initiator | Irgacure 379 | BASF Corporation | 3 |
| Photopolymerization initiator | Darocure TPO | BASF Corporation | 5 |
| Sensitizing agent | KAYACURE DETX-S | Nippon Kayaku Co., Ltd. | 2 |
| Polymerization inhibitor | UV-10 | BASF Corporation | 0.1 |
| Surfactant | KF351 | Shin-Etsu Chemical Co., Ltd. | 0.05 |

TABLE 2

| | Name | Manufacturer | Addition amount (part) |
|---|---|---|---|
| Polymerizable compound | 9G | Shin-Nakamura Chemical Co., Ltd. | 35 |
| Polymerizable compound | U-200PA | Shin-Nakamura Chemical Co., Ltd. | 5 |
| Polymerizable compound | 3G | Shin-Nakamura Chemical Co., Ltd. | 19.85 |
| Pigment dispersion | | | 20 |
| Gelling agent | KAO WAX T-1 | Kao Corporation | 5 |
| Photopolymerization initiator | Darocure TPO | BASF Corporation | 3 |
| Photopolymerization initiator | Procure TPO | BASF Corporation | 5 |
| Sensitizing agent | KAYACURE DETX-S | Nippon Kayaku Co., Ltd. | 2 |
| Polymerization inhibitor | UV-10 | BASF Corporation | 0.1 |
| Surfactant | KF351 | Shin-Etsu Chemical Co., Ltd. | 0.05 |

TABLE 3

| | Name | Manufacturer | Addition amount (part) |
|---|---|---|---|
| Polymerizable compound | 14G | Shin-Nakamura Chemical Co., Ltd. | 45 |
| Polymerizable compound | A-HD-N | Shin-Nakamura Chemical Co., Ltd. | 14.85 |
| Pigment dispersion | | | 20 |
| Gelling agent | KAO WAX T-1 | Kao Corporation | 5 |

TABLE 3-continued

| | Name | Manufacturer | Addition amount (part) |
|---|---|---|---|
| Photopolymerization initiator | Irgacure 379 | BASF Corporation | 3 |
| Photopolymerization initiator | Darocure TPO | BASF Corporation | 5 |
| Sensitizing agent | KAYACURE DETX-S | Nippon Kayaku Co., Ltd. | 2 |
| Polymerization inhibitor | UV-10 | BASF Corporation | 0.1 |
| Surfactant | KF351 | Shin-Etsu Chemical Co., Ltd. | 0.05 |

TABLE 4

| | Name | Manufacturer | Addition amount (part) |
|---|---|---|---|
| Polymerizable compound | UA-4200 | Shin-Nakamura Chemical Co., Ltd. | 35 |
| Polymerizable compound | A-HD-N | Shin-Nakamura Chemical Co., Ltd. | 24.85 |
| Pigment dispersion | | | 20 |
| Gelling agent | KAO WAX T-1 | Kao Corporation | 5 |
| Photopolymerization initiator | Irgacure 379 | BASF Corporation | 3 |
| Photopolymerization initiator | Darocure TPO | BASF Corporation | 5 |
| Sensitizing agent | KAYACURE DETX-S | Nippon Kayaku Co., Ltd. | 2 |
| Polymerization inhibitor | UV-10 | BASF Corporation | 0.1 |
| Surfactant | KF351 | Shin-Etsu Chemical Co., Ltd. | 0.05 |

TABLE 5

| | Name | Manufacturer | Addition amount (part) |
|---|---|---|---|
| Polymerizable compound | AD-TMP | Shin-Nakamura Chemical Co., Ltd. | 30 |
| Polymerizable compound | A-GLY-9E | Shin-Nakamura Chemical Co., Ltd. | 20 |
| Polymerizable compound | HD-N | Shin-Nakamura Chemical Co., Ltd. | 9.85 |
| Pigment dispersion | | | 20 |
| Gelling agent | KAO WAX T-1 | Kao Corporation | 5 |
| Photopolymerization initiator | Irgacure 379 | BASF Corporation | 3 |
| Photopolymerization initiator | Darocure TPO | BASF Corporation | 5 |
| Sensitizing agent | KAYACURE DETX-S | Nippon Kayaku Co., Ltd. | 2 |
| Polymerization inhibitor | UV-10 | BASF Corporation | 0.1 |
| Surfactant | KF351 | Shin-Etsu Chemical Co., Ltd. | 0.05 |

TABLE 6

| | Name | Manufacturer | Addition amount (part) |
|---|---|---|---|
| Polymerizable compound | U-200PA | Shin-Nakamura Chemical Co., Ltd. | 13 |
| Polymerizable compound | A-GLY-9E | Shin-Nakamura Chemical Co., Ltd. | 5 |

TABLE 6-continued

| | Name | Manufacturer | Addition amount (part) |
|---|---|---|---|
| Polymerizable compound | HD-N | Shin-Nakamura Chemical Co., Ltd. | 41.85 |
| Pigment dispersion | | | 20 |
| Gelling agent | KAO WAX T-1 | Kao Corporation | 5 |
| Photopolymerization initiator | Irgacure 379 | BASF Corporation | 3 |
| Photopolymerization initiator | Darocure TPO | BASF Corporation | 5 |
| Sensitizing agent | KAYACURE DETX-S | Nippon Kayaku Co., Ltd. | 2 |
| Polymerization inhibitor | UV-10 | BASF Corporation | 0.1 |
| Surfactant | KF351 | Shin-Etsu Chemical Co., Ltd. | 0.05 |

Each of the compositions illustrated in Tables 1 to 6 is subjected to filtration with a Teflon® 3 [mm] membrane filter (manufactured by ADVATEC MFS, Inc.), and a composition after filtration is obtained as ink.

Figure 5:
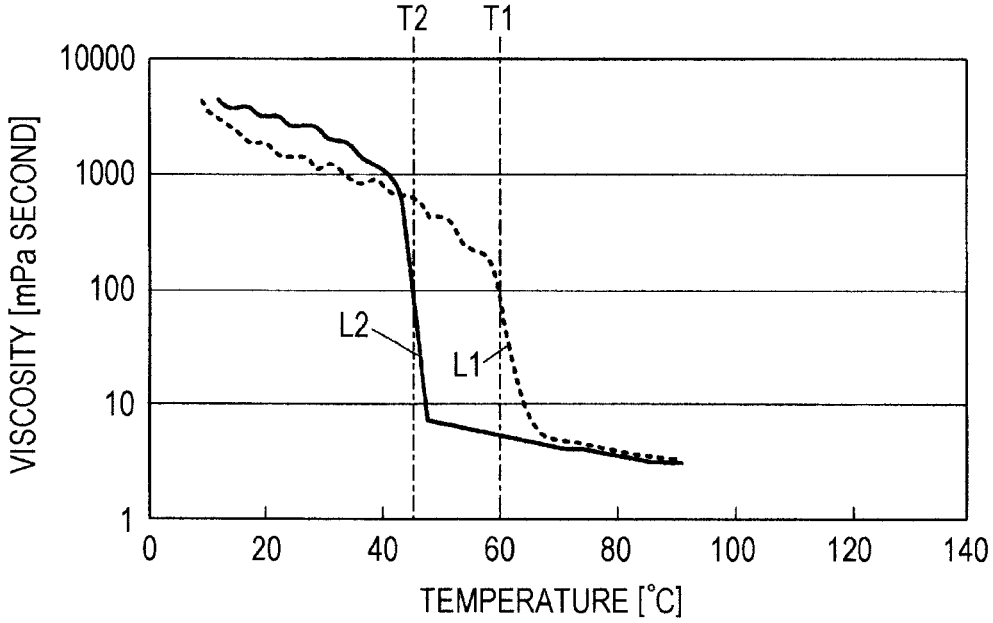
FIG. 5 is a graph illustrating an example of a variation in viscosity of ink in accordance with a temperature rise and a temperature fall of the ink, and a first temperature and a second temperature.

FIG. 5 illustrates an example of a variation in viscosity of ink in accordance with a temperature rise and a temperature fall of the ink, and a first temperature and a second temperature. A line L1 illustrated in FIG. 5 illustrates an example of a variation in viscosity of ink during temperature rise, and a line L2 in FIG. 5 illustrates an example of a variation in viscosity of ink during temperature fall.

For example, a graph illustrated in FIG. 5 is obtained by measuring a variation in dynamic viscoelasticity of ink in accordance with a temperature variation by using a rheometer. Specifically, the graph illustrated in FIG. 5 is obtained by obtaining a variation curve of the dynamic viscoelasticity of ink in a case where a temperature of the ink is raised from 10 [C] to 90 [C] under conditions of a predetermined shear rate (for example, 11.7 [1/second]) and a predetermined temperature variation degree (for example, 0.1 [C/second]), and the temperature is lowered to 10 [C].

As illustrated in FIG. 5, a viscosity variation curve of ink during temperature rise which is represented by the line L1, and a viscosity variation curve of ink during temperature fall which is represented by the line L2 are different from each other. Specifically, in a case of ink in the graph illustrated in FIG. 5, when a temperature of the ink during temperature rise is 60 [C] or higher, the viscosity of the ink is lower than 100 [mPa second]. On the other hand, when the temperature falls to lower than 45 [C], the viscosity of the ink during temperature fall is higher than 100 [mPa second]. Here, in a case where 60 [C] is set to a first temperature (T1 illustrated in FIG. 5), and 45 [C] is set to a second temperature (T2 illustrated in FIG. 5), the viscosity of the ink is lower than 100 [mPa second] at a temperature higher than the first temperature during temperature rise, and thus the ink becomes a liquid phase. In addition, the viscosity of the ink is higher than 100 [mPa second] at a temperature lower than the second temperature during temperature fall, and thus the ink becomes a gel phase, and when a temperature further falls, the ink becomes a solid phase. In other words, the ink is not gelated at a temperature that is equal to or higher than the second temperature during temperature fall, and thus the ink is maintained as is at a liquefied state during temperature rise.

As described above, the ink according to the invention becomes a liquid phase at a temperature equal to or higher than the first temperature, and becomes a gel phase or a solid phase at a temperature lower than the second temperature that is lower than the first temperature after becoming the liquid phase. On the other hand, the viscosity variation example of the ink similar to the graph illustrated in FIG. 5, or a correspondence relationship between a temperature and a viscosity variation are illustrative only. Even though a difference is present in temperatures corresponding to the first temperature and the second temperature, the ink that can be used in the invention becomes a liquid phase at a temperature equal to or higher than the first temperature, and becomes a gel phase or a solid phase at a temperature lower than the second temperature that is lower than the first temperature after becoming the liquid phase.

In addition, basically, the ink has a property in which the higher a temperature is, the further viscosity decreases regardless of a temperature variation in the vicinity of a temperature at which phase change between the liquid phase, and the gel phase or the solid phase occurs. From this property, regardless of a minimum requirement in which a temperature is equal to or higher than a temperature (equal to or higher than the second temperature) at which the ink in a liquid phase through heating is maintained at the liquid phase, when the temperature of the ink inside the recording head 241 is maintained at a relatively higher temperature (equal to or higher than the first temperature), the recording head 241 can eject the ink in a more satisfactory manner.

However, when the temperature of the recording head 241 excessively rises, and enters an overheated state, a problem relating to operation of the recording head 241 occurs. In addition, in ink having the compositions as illustrated in Tables 1 to 6, when a temperature is excessively high, a chemical change such as thermal polymerization occurs, and thus it is difficult for the ink to exhibit assumed performance. From this viewpoint, it is preferable that the temperature of the recording head 241 and the ink in this embodiment be managed at a temperature that is equal to or lower than 100 [C]. In other words, the first temperature is a temperature (upper limit temperature) that becomes an upper limit. The upper limit temperature is a highest temperature (for example, 100 [C]) in a range in which a problem relating to overheating does not occur in mechanical operation of the recording head 241 and ink properties during ejection of the ink from the recording head 241.

On the other hand, with regard to a storage section, a supply passage 301, and a recovery passage 302 which are described later, it is also preferable that the upper limit temperature be managed at a highest temperature (for example, 100 [C]) in a range in which a problem relating overheating does not occur in the function of the storage section, the supply passage 301, and the recovery passage 302, or characteristics of ink.

The ink is stored in a first storage section 242, a second storage section 243 in the head unit 24, and the like. A mechanism of supplying the ink from the first storage section 242 and the second storage section 243 to the recording head 241 will be described later. Hereinafter, in a simple description as "storage section", the description represents both of the first storage section 242 and the second storage section 243 unless otherwise stated.

For example, the irradiation unit 25 includes a fluorescent tube such as a low-pressure mercury lamp, and an energy ray such an ultraviolet ray is emitted by light emission of the fluorescent tube. The irradiation unit 25 is provided in the vicinity of the outer peripheral surface of the image forming drum 21 to be located downstream of the head unit 24 in a transporting direction of the recording medium P by rotation of the image forming drum 21. The irradiation unit 25 irradiates the recording medium P, which is carried on the image forming drum 21 and to which ink is ejected, with the energy ray to cure the ink on the recording medium P through operation of the energy ray.

On the other hand, the fluorescent tube that emits the ultraviolet ray is not limited to the low-pressure mercury lamp, and examples thereof include a mercury lamp having an operation pressure of approximately several hundred [Pa] to 1 [mega Pa], a light source that can be used as a sterilization lamp, a cold-cathode tube, an ultraviolet laser light source, a metal halide lamp, and a light-emitting diode. Among these, a power-saving light source (for example, the light-emitting diode), which can carry out irradiation of an ultraviolet ray with high illumination, is preferable. In addition, the energy ray is not limited to the ultraviolet ray, and may be an energy ray having a property of curing the ink in accordance with properties of the ink, and the light source is also substituted in accordance with the energy ray.

The delivery unit 26 includes a transporting mechanism that transports the recording medium P on a belt 263 by driving a ring-shaped belt 263 of which an inner side is carried by a plurality of (for example, two) rollers 261 and 262, a cylindrical delivery drum 264 that transports the recording medium P from the image forming drum 21 to the transporting mechanism, and the like. The delivery unit 26 transports the recording medium P, which is transported onto the belt 263 by the delivery drum 264, to follow the belt 263, and feeds the recording medium P to the paper ejecting section 30.

The cleaning unit 27 includes waste ink section (not illustrated) which receives ink ejected from the head unit 24 and stores the ink during maintenance, and the like, and prevents the inside of the image forming section 20 from being contaminated by the ink ejected from the head unit 24 during maintenance.

The paper ejecting section 30 includes a plate-shaped paper ejection tray 31 on which the recording medium P transported form the image forming section 20 by the delivery unit 26 is placed, and the like, and stores the recording medium P, on which an image formed, before the recording medium P is taken out by a user.

Next, description will be given of an ink ejection mechanism 300 and respective configurations relating to the ink ejection mechanism. Here, the ink ejection mechanism 300 represents a mechanism relating to operation of ejecting ink from the plurality of nozzles N of the recording head 241, and includes a mechanism that supplies ink to the recording head 241.

Figure 6:
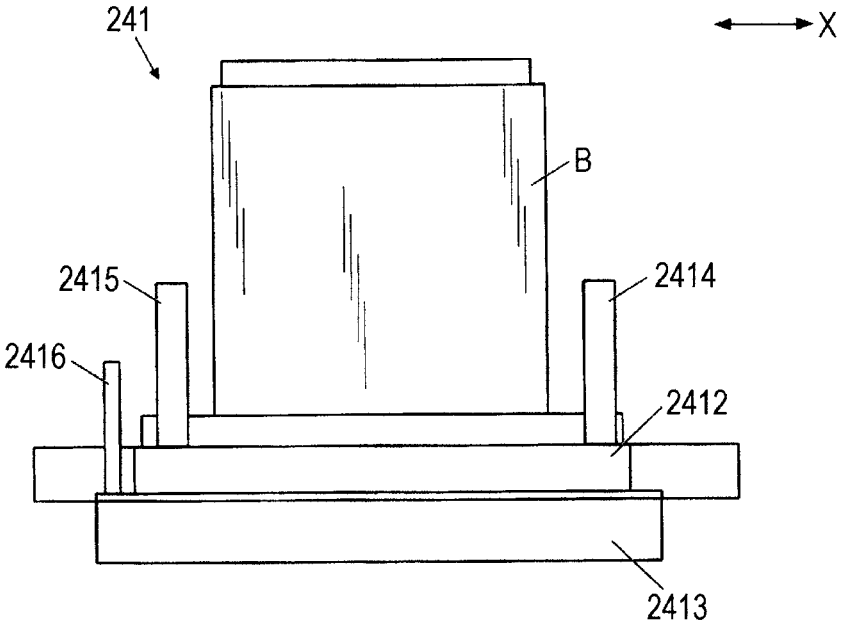
FIG. 6 is a side view of a recording head.

FIG. 6 is a side view of the recording head 241. A lateral surface stated here represents a surface along one lateral surface of the head unit 24.

As illustrated in FIG. 6, the recording head 241 includes an upper flow passage portion 2412 and a lower flow passage portion 2413 through which ink ejected from the recording head 241 flows, a supply hole 2414 into which ink to be supplied into the upper flow passage portion 2412 and the lower flow passage portion 2413 flows, a discharge hole 2415 from which ink reflowing from the upper flow passage portion 2412 to the second storage section 243 flows, a bypass portion 2416 through which ink reflowing from the lower flow passage portion 2413 to the second storage section 243 flows, and the like.

The upper flow passage portion 2412 guides ink, which flows through the supply hole 2414, to the lower flow passage portion 2413 through a filter. The ink, which is supplied from the supply hole 2414, flows inside the upper flow passage portion 2412 and the lower flow passage portion 2413, and reaches the plurality of nozzles N.

The supply hole 2414 and the discharge hole 2415 become a continuous ink flow passage. That is, ink, which flows to the upper flow passage portion 2412 may flow out to a discharge hole 2415 side without limitation to the plurality of nozzles N. In addition, in the lower flow passage portion 2413, a common flow passage (described later), which is provided on an inner side of the lower flow passage portion 2413, is connected to the bypass portion 2416. That is, ink, which flows to the lower flow passage portion 2413, may flow out to a bypass portion 2416 side without limitation to the plurality of nozzles N.

In addition, the recording head 241 includes a recording head control unit 2419 (refer to FIG. 10). For example, the recording head control unit 2419 is provided inside a casing B that is located on an upper side of the upper flow passage portion 2412, and controls operation of each channel C (refer to FIG. 7) under control of the control unit 40.

FIG. 7 is a cross-sectional view of the lower flow passage portion 2413 along a plane perpendicular to the X-direction.

The lower flow passage portion 2413 of the recording head 241 includes an inkjet head chip 501, which is an actuator for ink ejection, at the inside of a holder 502 formed from a metal such as aluminum. For example, as illustrated in FIG. 7, the holder 502 comes into contact with a cover substrate 503 that is provided on a lateral surface of the inkjet head chip 501, and the like, thereby supporting the inkjet head chip 501.

An opening 503*a*, which communicates with each channel C, is provided in the cover substrate 503. The opening 503*a* is covered with the manifold 504 on an outer side of the lateral surface on which the cover substrate 503 is provided, and on an inner side of the holder 502. The manifold 504 forms a common flow passage of ink which is continuous so as to be connected to a plurality of the openings 503*a* provided along the X-direction. In addition, although not illustrated, the manifold 504 is provided to extend to the upper flow passage portion 2412, and is separated between the upper flow passage portion 2412 and the common flow passage by a filter. That is, the common flow passage communicates with the supply hole 2414 and the discharge hole 2415 through the filter and the upper flow passage portion 2412. On the other hand, the bypass portion 2416 is connected to the common flow passage without through the filter and the upper flow passage portion 2412. That is, in a case where ink flows to the bypass portion 2416, ink supplied from the supply hole 2414 flows through the upper flow passage portion 2412, the filter, and the common flow passage, and reaches the bypass portion 2416.

The inkjet head chip 501 includes a plurality of channel rows in which the channel C communicating with the plurality of nozzles N provided in a nozzle plate 505 that is attached to the bottom surface of the inkjet head chip 501, and a partition wall (not illustrated) that operates to apply a pressure with respect to the channel C are alternately provided along the X-direction.

The casing B formed from a synthetic resin is connected to an upper side of the holder 502. A drive substrate is provided in the casing B. A circuit that constitutes the recording head control unit 2419 and the like are provided on the drive substrate. The drive substrate and the inkjet head chip 501 are electrically connected to each other through a flexible printed circuit (FPC) 506.

The partition wall is formed by a piezoelectric element that is subjected to a polarization treatment. When a drive voltage output from the recording head control unit 2419 is applied to electrodes which are formed on both surfaces of the partition wall through the FPC 506, the partition wall deforms to expand or contract the channel C in accordance with the drive voltage. As a result, a pressure for ejection is applied to ink inside the channel C, and thus the ink is ejected from the nozzles N.

In accordance with the application of the drive voltage, the partition wall and respective members, which constitute channel C, generate heat. In addition, the circuit on the drive substrate provided inside the casing B, and the like generate heat. Heat, which is generated in the recording head 241 including the members, is transmitted to the base portion 246 through the holder 502. As illustrated in FIG. 7, the holder 502 is inserted into and is held by the base portion 246, and thus the recording head 241 is attached to the base portion 246. Here, the holder 502 and the base portion 246 come into contact with each other, and thus heat of respective portions of the recording head 241, which is transmitted to the holder 502, is transmitted to the base portion 246.

Figure 8:
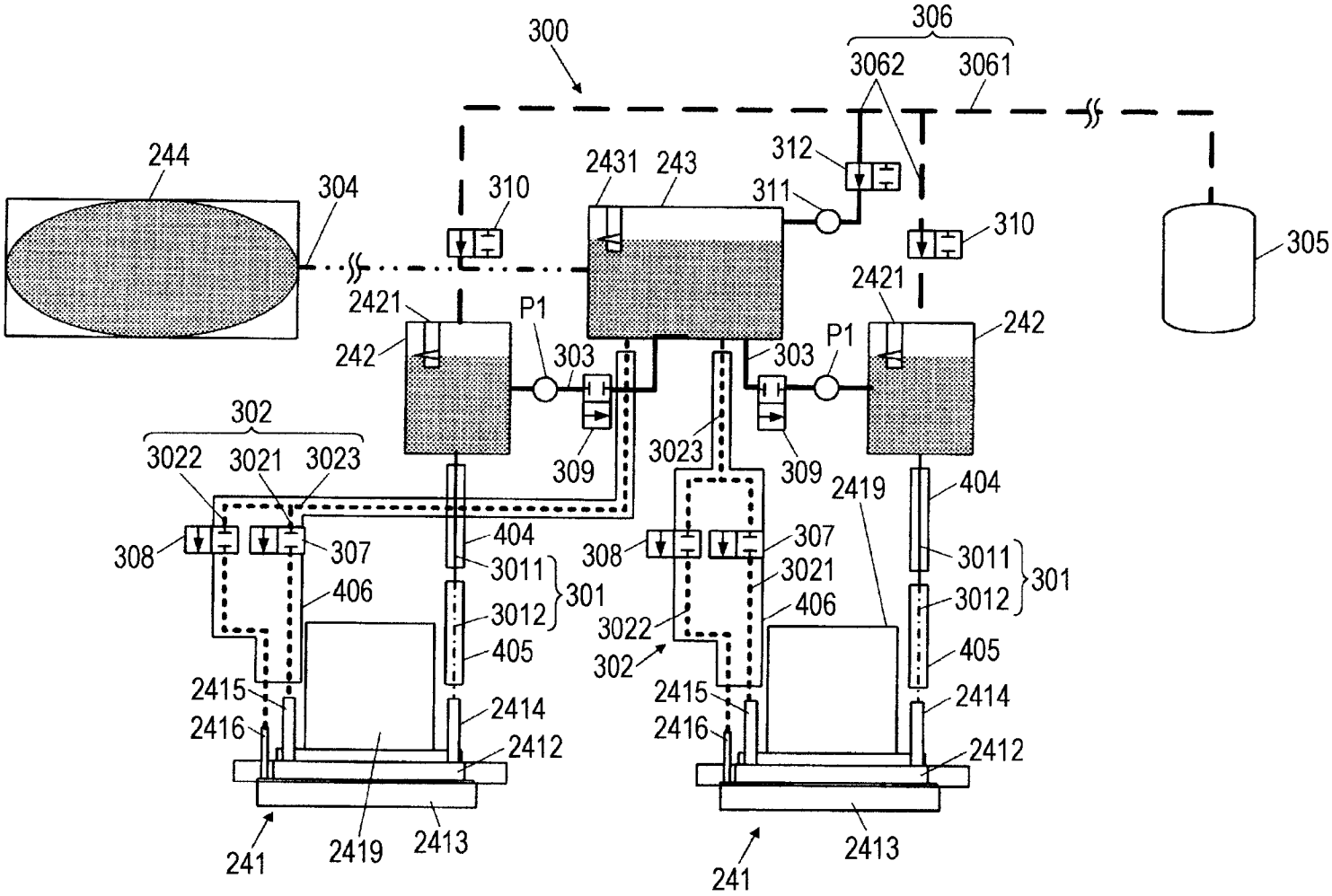
FIG. 8 is a schematic view illustrating a main configuration of an ink ejection mechanism, and connection between respective units of the ink ejection mechanism.

FIG. 8 is a schematic view illustrating a main configuration of the ink ejection mechanism 300 and connection between respective portions of the ink ejection mechanism 300. On the other hand, in FIG. 8 and the like, respective routes which become passages of ink are indicated by a broken line and the like, but a specific configuration of the respective routes is set in such a manner that ink or air passes therethrough.

As illustrated in FIG. 8, the first storage section 242 and the supply hole 2414 of the recording head 241 are connected to each other through the supply passage 301.

The supply passage 301 includes a first supply passage 3011 and a second supply passage 3012. On the other hand, in FIG. 8 and the like, the first supply passage 3011 is indicated by a solid line, and the second supply passage 3012 is indicated by a one-dot chain line.

Figure 9:
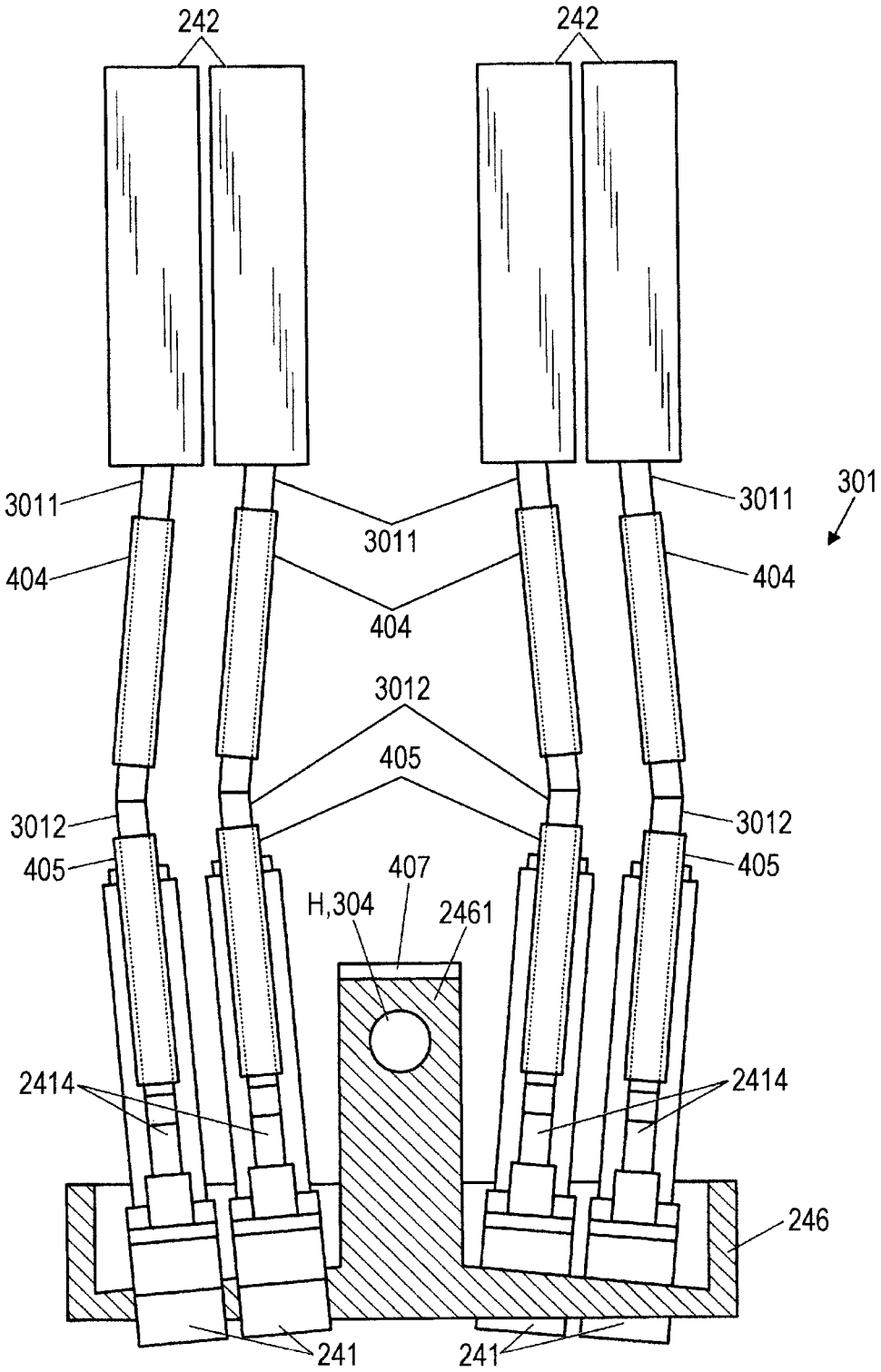

FIG. 9 is a view illustrating an example of a structure of the first supply passage 3011, the second supply passage 3012, and the like.

One side of the first supply passage 3011 is connected to the storage section (first storage section 242). In addition, the other side of the first supply passage 3011 is connected to the second supply passage 3012. That is, ink, which is supplied from the storage section (first storage section 242) to the recording head 241, flows to the first supply passage 3011.

The second supply passage 3012 is provided to connect the first supply passage 3011 and the recording head 241. Specifically, one side of the second supply passage 3012 is connected to the first supply passage 3011, and the other side of the second supply passage 3012 is connected to the supply hole 2414 of the recording head 241.

Ink, which is supplied from the first storage section 242 to the recording head, flows through the first supply passage 3011, and is guided to the recording head 241 by the second supply passage 3012.

The first supply passage 3011 and the second supply passage 3012 are connected to each other at a predetermined position between the storage section (first storage section 242) and the recording head 241. For example, the predetermined position is a bent portion that becomes a corner (turning point) of the ink route in the supply passage 301.

In addition, the second storage section 243 and the recording head 241 are connected to each other through the recovery passage 302.

Specifically, for example, the recovery passage 302 includes a first recovery passage 3021 that is connected to the discharge hole 2415 of the recording head 241, a second recovery passage 3022 that is connected to the bypass portion 2416 of the recording head 241, and a common recovery passage 3023 at which two recovery passages including the first recovery passage 3021 and the second recovery passage 3022 are joined to each other, and which is connected to the second storage section 243.

The first storage section 242 and the second storage section 243 are connected to each other through a route 303 in which the pump P1 is provided. The pump P1 supplies ink, which is stored in the second storage section 243, to the first storage section 242. As the pump P1, for example, a volume type pump such as a diaphragm pump, a tube pump, and the like can be used. The pump P1 operates under control of the control unit 40.

In addition, an ink tank 244 is connected to the second storage section 243. The ink tank 244 stores ink to be supplied to the second storage section 243. The second storage section 243 and the ink tank 244 are connected to each other through a route 304 that is connected to a pump (not illustrated), and ink is supplied from the ink tank 244 to the second storage section 243 in accordance with operation of the pump under control of the control unit 40.

In addition, the first storage section 242 includes a heating unit 402. In addition, the second storage section 243 includes a heating unit 403. Although not illustrated in FIG. 8, for example, the heating unit 402 or the heating unit 403 is provided to come into contact with an outer peripheral surface of a container.

In addition, a part of the route 304 is provided at the base portion 246.

Specifically, for example, the base portion 246 includes a protruding portion 2461 that is provided to protrude toward an upper side from a flat surface portion to which the recording head 241 is attached. For example, the protruding portion 2461 is provided along a row in which one set of recording heads 241 are formed on a flat surface portion. In addition, the protruding portion 2461 is located midway between two rows in which two sets of recording heads 241 are formed.

Here, as illustrated in FIG. 3A or FIG. 9, a flow passage H functioning as an ink flow passage is formed on an inner side of the protruding portion 2461. The flow passage His a hollow flow passage that communicates with the ink tank and the second storage section 243, and functions as a part of the route 304.

In this example, the flow passage H and the ink tank 244, and the flow passage H and the second storage section 243 communicate with each other, respectively, through a tubular member that is separately provided. However, this configuration is illustrative only, and there is no limitation to the configuration.

The supply passage 301, the recovery passage 302, and the route 303 are tubular members through which ink passes. For example, the supply passage 301, the recovery passage 302, and the route 303 are formed from a resin and the like. However, this configuration is illustrative only, and there is no limitation to the configuration. It is preferable that the supply passage 301, the recovery passage 302, and the route 303 be configured as a member with excellent thermal conductivity. In addition, this is also true of a member that allows the flow passage H and the ink tank 244, and the flow passage H and the second storage section 243 to communicate with each other, respectively, in this embodiment.

In addition, a leakage prevention unit 305 is connected to the first storage section 242. For example, the leakage prevention unit 305 is a pump that is provided to suction air inside the first storage section 242. During operation, the leakage prevention unit 305 is connected to the first storage section 242, and makes a pressure inside the channel C of the recording head 241 enter a negative pressure state through the first storage section 242 and the supply passage 301. As a result, ink is prevented from being leaked from the nozzles N during not carrying out image formation or various kinds of maintenance.

The first storage section 242 and the leakage prevention unit 305 are connected to each other through a ventilation passage 306. The ventilation passage 306 is a tubular member through which air passes, and is formed from, for example, a resin. That is, the leakage prevention unit 305 changes atmospheric pressure inside the first storage section 242 under control of the control unit 40.

Here, for example, as illustrated in FIG. 8, the ventilation passage 306 has a structure of diverging into a plurality of ventilation passages 3062, which are respectively connected to a plurality of the first storage sections 242, from one common ventilation passage 3061 that is connected to the leakage prevention unit 305. However, this structure is illustrative only, and can be appropriately changed without limitation thereto.

In addition, a pressure control unit 311 is connected to the second storage section 243.

For example, the pressure control unit 311 is a pump that is provided to suction air inside the second storage section 243. During operation, the pressure control unit 311 discharges gas inside the second storage section 243 to allow the inside of the second storage section 243 to enter a negative pressure state.

In addition, an electromagnetic valve 312 is provided in a gas flow passage that is connected from the second storage section 243 to a space outside the second storage section 243 through the pressure control unit 311.

Specifically, for example, the electromagnetic valve 312 is provided on a route that connects the pressure control unit 311 and a space in which outside air exists. The electromagnetic valve 312 opens or closes the route that connects the pressure control unit 311 and the space in which outside air exists, thereby switching opening or shut-off of gas entrance and exit with respect to the inside of the second storage section 243 through the pressure control unit 311.

Disposition of the electromagnetic valve 312 of this embodiment is illustrative only, and there is no limitation thereto. For example, the electromagnetic valve 312 may be provided in a gas flow passage between the second storage section 243 and the pressure control unit 311.

In addition, electromagnetic valves 307, 308, 309, and 310 are provided in the first recovery passage 3021, the second recovery passage 3022, the route 303, and the diverged ventilation passage 3062, respectively. The electromagnetic valves 307, 308, 309, and 310 open or close the ink flow passage or the ventilation passage, respectively, under control of the control unit 40.

On the other hand, for example, the electromagnetic valve 309 in the route 303 in which the pump P1 is formed is provided to be interposed between the second storage section 243 and the pump P1. However, this configuration is illustrative only, and this configuration may be appropriately changed without limitation thereto.

In addition, the first storage section 242 is hermetically sealed except for the above-described various connection sites. Specifically, for example, the first storage section 242 is a container having hermetic sealing properties against outside air. That is, the electromagnetic valve 310 functions as a configuration (first switching unit) that switches opening or shut-off of gas entrance and exit with respect to the inside of the first storage section 242.

A pressure inside the first storage section 242 varies in accordance with a degree of a negative pressure that is applied by the leakage prevention unit 305, the amount of ink supplied from the second storage section 243, and the like. For example, in a state in which the electromagnetic valve 310 enters a closed state, and thus the negative pressure applied by the leakage prevention unit 305 disappears, when ink is supplied from the second storage section 243, the pressure inside the first storage section 242 increases in accordance with an increase in the amount of ink inside the first storage section 242.

In addition, the second storage section 243 is hermetically sealed except for the above-described various connection sites. Specifically, for example, the second storage section 243 is a container having hermetic sealing properties against outside air. That is, the electromagnetic valve 312 functions as a configuration (second switching unit) that switches opening or shut-off of gas entrance and exit with respect to the inside of the second storage section 243.

A pressure inside the second storage section 243 varies in accordance with a degree of a negative pressure that is applied by the pressure control unit 311, the amount of ink supplied to the first storage section 242, and the like. For example, in a state in which the electromagnetic valves 307, 308, and 312 are closed, when ink is supplied from the second storage section 243 to the first storage section 242, the pressure inside the second storage section 243 decreases in accordance with a decrease in the amount of ink inside the second storage section 243.

In addition, a pressure detection unit 313, which measures a pressure inside the second storage section, is provided to the second storage section 243.

For example, the pressure detection unit 313 includes a barometer that is provided to measure an atmospheric pressure of a space, in which ink does not exist, inside the second storage section 243, and the like, and measures the pressure inside the second storage section 243 in accordance with the resultant measurement result of the atmospheric pressure.

In addition, the ink ejection mechanism 300 includes heating units 404, 405, 406, and 407 which are individually provided to the first supply passage 3011, the second supply passage 3012, the recovery passage, and the base portion 246 in addition to the heating unit 401 of the recording head 241, the heating unit 402 of the first storage section 242, and the heating unit 403 of the second storage section 243.

Specifically, for example, the heating units 404 and 405 are provided to come into contact with the outer periphery of the first supply passage 3011 and the second supply passage 3012. In addition, for example, the heating unit 406 is provided to come into contact with the outer periphery of the recovery passage 302. In addition, for example, the heating unit 407 is provided to come into contact with an upper surface of the protruding portion 2461.

For example, the heating units 401 to 407 include a heating wire, and the like, and generate heat in accordance with electrification. However, this configuration is illustrative only, and there is no limitation thereto.

In addition, the ink ejection mechanism 300 includes a detection unit that measures a temperature of each of the recording head 241, the storage section, the first supply passage 3011, and the second supply passage 3012.

Specifically, for example, the recording head 241 includes a detection unit 411 that is provided to come into contact with the cover substrate 503.

In addition, the first storage section 242 includes a detection unit 412. In addition, the second storage section 243 includes a detection unit 413. Although not illustrated in FIG. 8, and the like, for example, the detection unit 412 or the detection unit 413 is provided at a predetermined position coming into contact with ink stored in a container.

In addition, the first supply passage 3011 includes a detection unit 414. In addition, the second supply passage 3012 includes a detection unit 415. In addition, the recovery passage 302 includes a detection unit 416. Although not illustrated in FIG. 8, and the like, for example, the detection units 414, 415, and 416 are provided at positions which come into contact with the outer periphery of the above-described passages and which are not directly heated by the heating units 404, 405, and 406.

In addition, for example, as illustrated in FIG. 3B, the base portion 246 includes a detection unit 417 that is provided at a position, at which the recording head 241 is not provided, on a flat surface portion.

For example, the detection units 411 to 417 are thermistors. However, this configuration is illustrative only, and other configurations, which can be used for measurement of a temperature, may be employed without limitation thereto.

FIG. 10 is a block diagram of the inkjet recording apparatus 1.

The control unit 40 includes a CPU 41, a RAM 42, a ROM 43, and the like.

The CPU 41 reads out and executes various programs, data, and the like, which correspond to process content, from a storage device such as the ROM 43, and controls the operation of respective units of the inkjet recording apparatus 1 in accordance with the process content that is executed. The RAM 42 temporarily stores various programs, data, and the like, which are processed by the CPU 41. The ROM 43 stores various programs, data, and the like which are read out by the CPU 41 and the like.

In addition, as illustrated in FIG. 10, the control unit 40 is connected to respective units of the inkjet recording apparatus 1, and controls the operation of the respective units to which the control unit 40 is connected. In addition, the control unit 40 controls the operation of the inkjet recording apparatus 1 in accordance with data input and output from the respective units.

For example, the control unit 40 carries out a process corresponding to an input from a user through an operation display unit 80 including a touch panel and the like. In addition, the control unit 40 allows the operation display unit 80 to carry out various kinds of display in accordance with the operation of the inkjet recording apparatus 1.

In addition, the control unit 40 acquires image data that is included in a printing job through a communication unit 50 which connects the inkjet recording apparatus 1 and an external apparatus so as to establish communication therebetween, and receives data such as the printing job that is transmitted from the external apparatus.

In addition, the control unit 40 carries out various image processes by using an image processing unit 60 with respect to image data that is acquired through the communication unit 50. Examples of the image processes which are carried out by the image processing unit 60 include an analysis process, a rasterization process, and the like. However, these are illustrative only, and there is no limitation thereto.

In addition, the control unit 40 carries out operation control of respective units, which relates to transportation of the recording medium P in the paper feeding section 10 or the image forming section 20, through a transportation control unit 70 in accordance with image formation instruction from an external apparatus which is given in accordance with transmission of the printing job. Although not illustrated, the transportation control unit 70 is connected to respective units such as the transporting unit 12, the image forming drum 21, the delivering unit 22, and the delivery unit 26 which relate to transportation and carrying of the recording medium P, and controls the operation of the respective units.

In addition, the control unit 40 controls a carriage control unit 245 so as to control a position of the head unit 24, and sets the position of the head unit 24 during image formation to a position on an image forming drum 21 side. The carriage control unit 245 is connected to a drive unit (not illustrated) that operates the head unit 24 in the X-direction, and the like, and controls the operation of the drive unit and the like, thereby changing or maintaining the position of the head unit 24.

In addition, the control unit 40 collectively controls the operation of the recording head control unit 2419 so as to control ejection of ink from the nozzles N of the recording head 241. That is, the control unit 40 controls the operation of a plurality of recording heads 241 in accordance with an image that is formed on the recording medium P based on the image data.

In addition, the control unit 40 operates the paper heating unit 23 or the irradiation unit 25 during image formation.

On the other hand, during image formation or standby, the control unit 40 operates the leakage prevention unit 305, and sets the ventilation passage 306 to an opened state by using the electromagnetic valve 310. In addition, the control unit 40 sets the recovery passage 302 to a closed state by using the electromagnetic valves 307 and 308 during image formation.

In addition, in a case where ink is ejected from the plurality of nozzles N of the recording head 241 by image formation or maintenance of the recording head 241 and thus the amount of ink stored in the first storage section 242 or the second storage section 243 decreases, the control unit 40 carries out operation control of maintaining the amount of ink stored in the first storage section 242 or the second storage section 243 by supplying ink to the first storage section 242 or the second storage section 243 after termination of the maintenance.

Specifically, the control unit 40 acquires the residual amount of ink in the first storage section 242 and the second storage section 243 which is detected by liquid surface sensors 2421 and 2431 which are provided to the first storage section 242 and the second storage section 243. In a case where the residual amount of ink is less than a predetermined residual amount that is set to each of the storage sections, the control unit 40 operates a pump that is provided between the ink tank 244 and the second storage section 243, or the pump P1 that is provided between the second storage section 243 and the first storage section 242 so as to supply ink to the first storage section 242 or the second storage section 243.

The control unit 40 sets the route 303 to a closed state by using the electromagnetic valve 309 during non-operation of the pump P1, and carries out control of opening the route 303 before initiating operation of the pump P1, and closes the route 303 again after completion of the operation of the pump P1.

In addition, the control unit 40 controls operation of each of the heating units 401 to 407 in such a manner that the temperature of the recording head 241, the storage section, the first supply passage 3011, the second supply passage 3012, and the like reaches a temperature at which ink becomes a liquid phase.

On the other hand, for example, the "temperature at which ink becomes a liquid phase" represents a temperature that is equal to or higher than a temperature at which phase transition from a gel phase or a solid phase to a liquid phase occurs through heating, like the first temperature described above. Particularly, in this embodiment, the "temperature at which ink becomes a liquid phase" in the second storage section 243, to which ink in a gel phase before being heated is supplied, represents a temperature that is equal to or higher than the first temperature and is equal to or lower than the upper limit temperature.

In addition, similarly to a relationship between the first temperature and the second temperature in this embodiment, in a case of ink of which a phase transition temperature is different between temperature rise and temperature fall of the ink, a portion, to which ink heated once to a liquid phase is supplied, in the second storage section 243 is not necessary to be always maintained to a temperature equal to or higher than the first temperature so as to maintain the ink in a liquid phase, and the portion may be maintained to a temperature capable of maintaining the ink to the second temperature or higher. Accordingly, in this embodiment, the "temperature at which ink becomes a liquid phase" in the recording head 241, the first storage section 242, the first supply passage 3011, the second supply passage 3012, and the recovery passage 302 is a "temperature capable of maintaining the ink, which is heated once to a liquid phase, to the liquid phase", and, for example, becomes a "temperature equal to or higher than the second temperature" and is equal to or lower than the upper limit temperature. However, here, the example of the temperature described here is a minimum requirement of the "temperature at which ink becomes a liquid phase". Actually, as described above, the recording head 241 is maintained at a temperature equal to or higher than the first temperature and equal to or lower than the upper limit temperature in consideration of more satisfactory ink ejection. In addition, in a case where ink to be supplied to the second storage section 243 is already heated to a temperature equal to or higher than the first temperature, the "temperature at which the ink becomes a liquid phase" in the second storage section 243 is a "temperature equal to or higher than the second temperature" and is equal to or lower than the upper limit temperature.

In addition, the "temperature at which ink becomes a liquid phase" is appropriately set in accordance with characteristics of the ink. For example, in a case of ink of which a phase transition temperature is determined only to a unique temperature regardless of temperature rise and temperature fall of the ink, the "temperature at which ink becomes a liquid phase" is a temperature equal to or higher than the unique temperature and is equal to or lower than the upper limit temperature.

In accordance with control of the temperature of the recording head 241, the storage section, the first supply passage 3011, the second supply passage 3012, and the like, the control unit 40 measures the temperature of respective units such as the recording head 241, the storage section, the first supply passage 3011, and the second supply passage 3012 by using detection units which are provided to the respective units. The control unit 40 controls operation of the heating units, which are provided to the respective units, based on the measurement result obtained by the detection units.

Specifically, for example, as illustrated in Examples (1) to (3) in the following Table 7, the control unit 40 controls the operation of the heating units, which are provided to the respective units, to realize temperatures which are respectively set to the recording head 241, the storage section, the first supply passage 3011, the second supply passage 3012, and the like in accordance with a liquefaction temperature (for example, the first temperature) of ink. Here, the setting temperatures which are respectively set are temperatures at which ink becomes a liquid phase. In addition, the setting temperature of the storage section is higher than the setting temperature of the recording head 241, the setting temperature of the first supply passage 3011 and the setting temperature of the second supply passage 3012 are lower than the setting temperature of the recording head, and the setting temperature of the second supply passage 3012 is higher than the setting temperature of the first supply passage 3011.

TABLE 7

| Printing rate of 60% or less | | Temperature [C.] Storage section | First supply passage | Second supply passage | Recording head | Ejection | Temperature [C.] Kind of ink | First temperature [C.] |
|---|---|---|---|---|---|---|---|---|
| Examples | (1) | 80 | 65 | 67 | 70 | ○ | i | 63 |
| | (2) | 90 | 80 | 82 | 85 | ○ | ii | 78 |
| | (3) | 75 | 55 | 60 | 65 | ○ | iii | 50 |
| Comparative Examples | (4) | 75 | 75 | 75 | 75 | X | i | 63 |
| | (5) | 70 | 70 | 70 | 70 | X | i | 63 |
| | (6) | 70 | 75 | 75 | 70 | X | i | 63 |
| | (7) | 70 | 75 | 80 | 65 | X | i | 63 |
| | (8) | 75 | 75 | 65 | 65 | X | i | 63 |

According to the inkjet recording apparatus 1 of this embodiment, the temperature of the recording head 241, the storage section, the first supply passage 3011, the second supply passage 3012, and the like are set to a temperature at which ink becomes a liquid phase, and thus it is possible to eject ink in a liquid phase from the recording head 241 in a satisfactory manner. In addition, the temperature of the storage section is set to be higher than the temperature of the recording head 241, and thus it is possible to make ink be a liquid phase in a more reliable manner. In addition, the setting temperature of the first supply passage 3011 and the second supply passage 3012 is set to be lower than the setting temperature of the recording head 241, and thus it is possible to prevent the temperature of the recording head 241 from being excessively raised due to flowing of the ink, which is heated to a relatively higher temperature, from the storage section directly into the recording head 241. Accordingly, it is possible to prevent the recording head 241 from being overheated. In addition, the setting temperature of the second supply passage 3012 is set to be higher than the setting temperature of the first supply passage 3011, and thus it is possible to make the temperature of ink, which is caused to lower once at the first supply passage 3011, be close to a temperature optimal for the recording head 241 at the second supply passage 3012. Accordingly, it is possible to easily maintain the temperature of the recording head 241 to a desired temperature. As a result, it is possible to maintain the temperature of the recording head 241 to a more appropriate temperature, and it is possible to carry out ejection of ink in a satisfactory manner.

Figure 11:
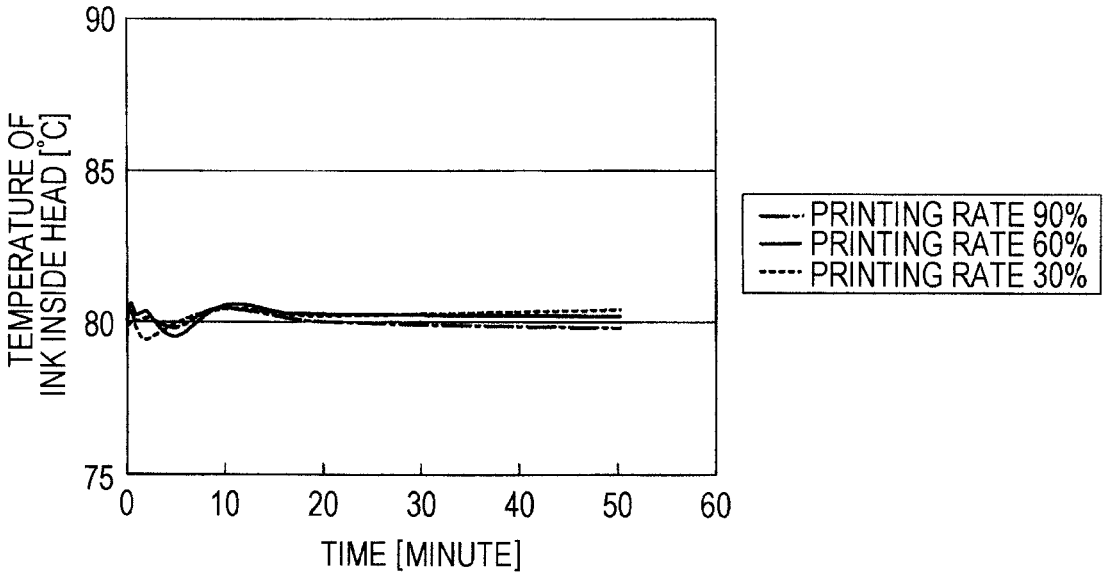
FIG. 11 is a graph illustrating an example of a temperature measurement result of ink inside the recording head in Examples.

Next, FIG. 11 illustrates an example of a temperature measurement result of ink inside the recording head 241 in Examples.

Similarly to Examples (1) to (3), when the setting temperature of the recording head 241, the storage section, the first supply passage 3011, and the second supply passage 3012 is set to a temperature at which ink becomes a liquid phase, the setting temperature of the storage section is set to be higher than the setting temperature of the recording head 241, the setting temperature of the first supply passage 3011 and the second supply passage 3012 is set to be lower than the setting temperature of the recording head 241, and the setting temperature of the second supply passage 3012 is set to be higher than the setting temperature of the first supply passage 3011, it is possible to maintain the temperature of ink inside the recording head 241 in an approximately constant manner. For example, in a case of Example (2), as illustrated as a printing rate of 30[%], and a printing rate of 60[%] in FIG. 11, it is possible to maintain the temperature of ink inside the recording head 241 to approximately 80 [C] in an approximately constant manner.

On the other hand, for example, similarly to Comparative Examples (4) and (5), when the setting temperature of the recording head 241, the storage section, the first supply passage 3011, and the second supply passage 3012 is uniform, in a case where heat is generated in accordance with operation of the recording head 241, it is difficult to constantly maintain the temperature of the recording head 241, and thus it is difficult to carry out stable ejection.

In addition, similarly to Comparative Examples (6) and (7), when the setting temperature of the first supply passage 3011 or the second supply passage 3012 is higher than the setting temperature of the recording head 241, the recording head 241 is heated when ink is supplied thereto. Here, when the recording head 241 operates, and heat generated increases, it is difficult to constantly maintain the temperature of the recording head 241, and thus it is difficult to carry out stable ejection.

In addition, similarly to Comparative Example (8), in a case where the setting temperature of the storage section is higher than the setting temperature of the recording head 241, but the setting temperatures of the storage section and the first supply passage 3011 are the same as each other, and the setting temperatures of the recording head 241 and the second supply passage 3012 are the same as each other, it is difficult to sufficiently lower the temperature of ink, which is heated to be liquefied at the storage section, before the ink is supplied to the recording head 241, and thus the recording head 241 is heated due to supply of the ink of which a temperature is high, and it is difficult to constantly maintain the temperature of the recording head 241. Accordingly, it is difficult to carry out stable ejection.

In addition, so as to realize a setting temperature that is set to the base portion 246 or the recovery passage 302, the control unit 40 may control operation of a temperature changing unit (for example, a heating unit) that is provided to each of the base portion 246 and the recovery passage 302.

For example, the setting temperature of the recovery passage 302 may be set to the same temperature as in the second supply passage 3012 or a predetermined temperature (for example, a temperature of the second supply passage 3012+5 [C]) higher than the setting temperature of the second supply passage 3012. When the setting temperature of the recovery passage 302 is set to be higher than the setting temperature of the second supply passage 3012, it is possible to decrease the viscosity of ink in the recovery passage 302 to be lower than that in the supply passage 301, and thus it is possible to allow ink inside the recording head 241 to reflow to the second storage section 243 in a satisfactory manner during the following reflow maintenance. On the other hand, the predetermined temperature is a temperature equal to or lower than the upper limit temperature.

In addition, the setting temperature of the base portion 246 may be set to a temperature (for example, a temperature equal to or higher than the second temperature) which is equal to or lower than the setting temperature of the recording head 241 and is capable of maintaining ink inside the recording head 241 to a liquid phase. As a result, it is possible to release heat, which is generated due to operation of the recording head 241, to the base portion 246. In addition, when the base portion 246 is set to a temperature capable of maintaining ink inside the recording head 241 in a liquid phase, heat of the recording head 241 is not excessively taken away to the base portion 246, and thus the flowability of ink inside the recording head 241 is not lost.

On the other hand, ink is not subjected to a process of being heated to the first temperature on an ink tank 244 side in relation to the second storage section 243, and thus the ink is transported from the ink tank 244 in a gel phase state. Specifically, ink inside the route 304 is in a gel state, but the ink is transported to the second storage section 243 due to a pressure obtained by the pump that is connected to the route 304.

If the ink before heating is allowed to pass through the inside of the base portion 246, in a case where the base portion 246 is excessively heated due to heat transfer from the recording head 241, it is possible to promote cooling-down of the base portion 246, and it is possible to warm the ink, which is heated in an ink route after the second storage section 243, as much as possible in advance.

Figure 12:
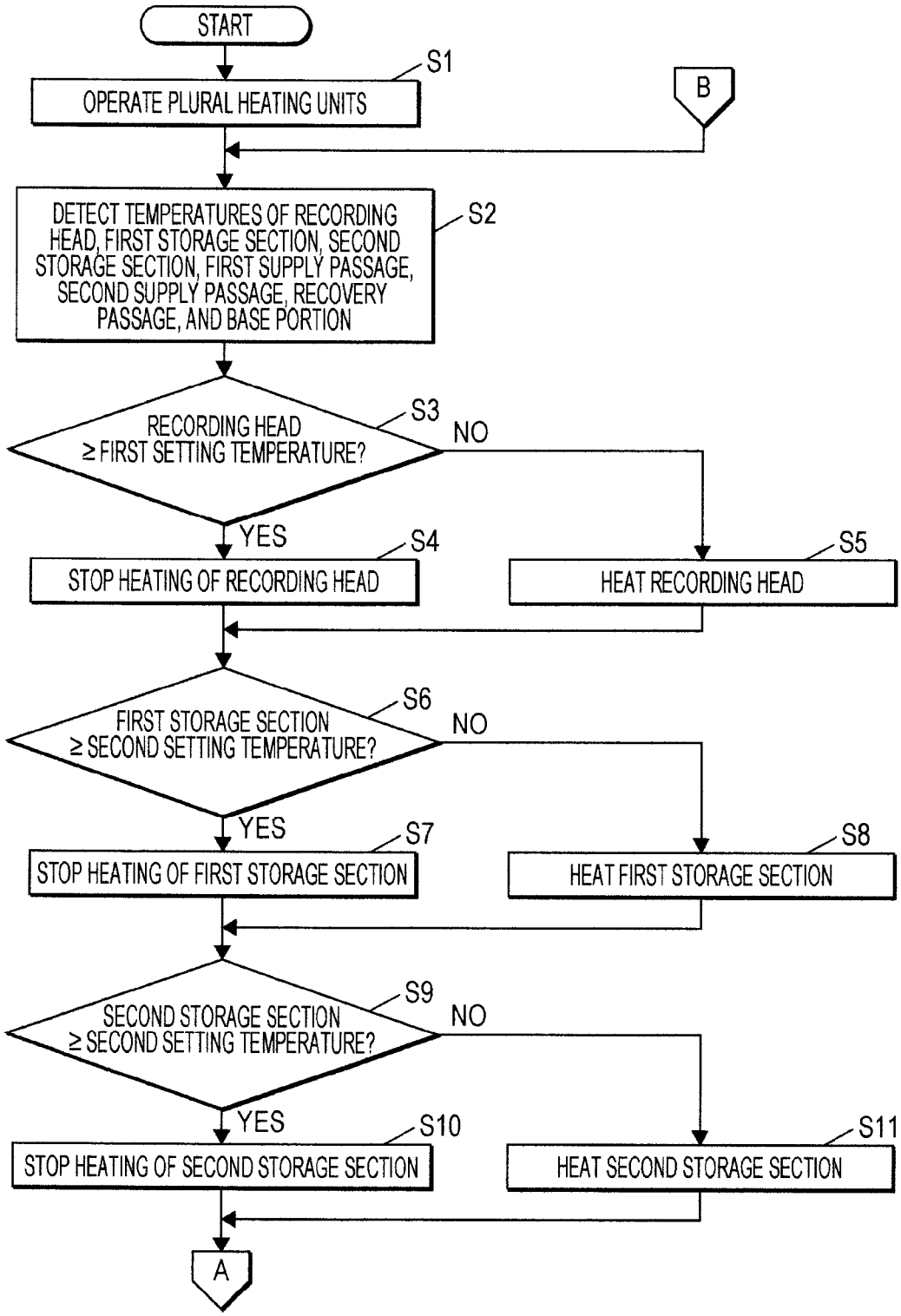
FIG. 12 is a flowchart illustrating an example of an operation control flow of a heating unit.
Figure 13:
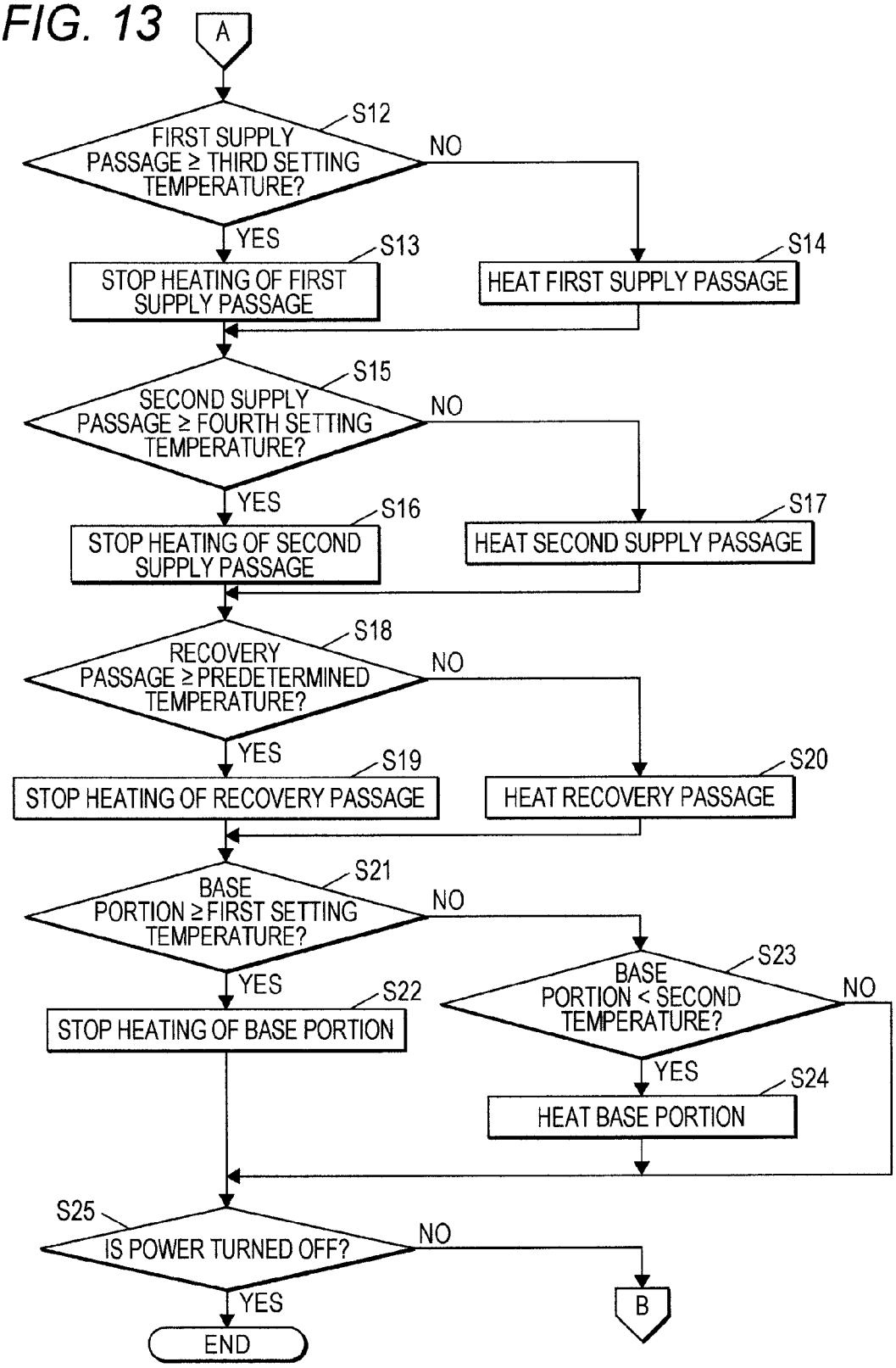
FIG. 13 is a flowchart illustrating an example of the operation control flow of the heating unit.

Next, description will be given of operation control of the heating units 401 to 407 with reference to flowcharts of FIGS. 12 and 13.

In the description made with reference to the flowcharts, an assumed temperature of the recording head 241, which is set in advance, is described as "first setting temperature" for convenience. For example, the first setting temperature is a temperature that is equal to or higher than the first temperature and is equal to or lower than the upper limit temperature.

In addition, assumed temperatures of the storage section, the first supply passage 3011, and the second supply passage 3012, which are determined in advance, are described as "second setting temperature", "third setting temperature", and "fourth setting temperature", respectively. Here, the first to fourth setting temperatures satisfy a relationship of the second setting temperature>the first setting temperature>the fourth setting temperature>the third setting temperature. In addition, the first to fourth setting temperatures are "temperatures at which ink becomes a liquid phase".

When power of the inkjet recording apparatus 1 is turned on, the control unit 40 operates each of the heating units 401 to 407, and allows the recording head 241, the first storage section 242, the second storage section 243, the supply passage 301, the recovery passage 302, and the base portion 246 to enter a state of being heated by the heating unit (step S1). In addition, the control unit 40 acquires information, which represents a temperature measured by the detection units 411 to 417, thereby acquiring a temperature of each of the recording head 241, the first storage section 242, the second storage section 243, the first supply passage 3011, the second supply passage 3012, the recovery passage 302, and the base portion 246 (step S2).

In a case where the temperature of the recording head 241, which is acquired in step S2, is equal to or higher than the first setting temperature (YES in step S3), the control unit 40 stops additional heating of the recording head 241 by the heating unit 401 (step S4). Specifically, the control unit 40 stops electrification with respect to the heating unit 401. When the heating from the heating unit 401 disappears, the recording head 241 is cooled down by outside air, or heat thereof is transferred to the base portion 246, and thus a temperature of the recording head 241 is lowered. On the other hand, with regard to a configuration other than heating, in a case where heating is stopped, a temperature is lowered through cooling-down by at least outside air, and the like.

On the other hand, the temperature of the recording head 241 is not equal to or higher than the first setting temperature (NO in step S3), the control unit 40 heats the recording head 241 by the heating unit 401 (step S5). Here, in a case where the heating unit 401 is operating already, the control unit 40 allows the heating unit 401 to continuously operate, and in a case where the operation of the heating unit 401 is stopped, the control unit 40 operates the heating unit 401.

In addition, in a case where the temperature of the first storage section 242, which is acquired in step S2, is equal to or higher than the second setting temperature (YES in step S6), the control unit 40 stops additional heating of the first storage section 242 by the heating unit 402 (step S7). On the other hand, in a case where the temperature of the first storage section 242 is not equal to or higher than the second setting temperature (NO in step S6), the control unit 40 heats the first storage section 242 by the heating unit 402 (step S8).

In addition, in a case where the temperature of the second storage section 243, which is acquired in step S2, is equal to or higher than the second setting temperature (YES in step S9), the control unit 40 stops additional heating of the second storage section 243 by the heating unit 403 (step S10). On the other hand, in a case where the temperature of the second storage section 243 is not equal to or higher than the second setting temperature (NO in step S9), the control unit 40 heats the second storage section 243 by the heating unit 403 (step S11).

In addition, in a case where the temperature of the first supply passage 3011, which is acquired in step S2, is equal to or higher than the third setting temperature (YES in step S12), the control unit 40 stops additional heating of the first supply passage 3011 by the heating unit 404 (step S13). On the other hand, in a case where the temperature of the first supply passage 3011 is not equal to or higher than the third setting temperature (NO in step S12), the control unit 40 heats the first supply passage 3011 by the heating unit 404 (step S14).

In addition, in a case where the temperature of the second supply passage 3012, which is acquired in step S2, is equal to or higher than the fourth setting temperature (YES in step S15), the control unit 40 stops additional heating of the second supply passage 3012 by the heating unit 405 (step S16). On the other hand, in a case where the temperature of the second supply passage 3012 is not equal to or higher than the fourth setting temperature (NO in step S15), the control unit 40 heats the second supply passage 3012 by the heating unit 405 (step S17).

In addition, in a case where the temperature of the recovery passage 302, which is acquired in step S2, is equal to or higher than a predetermined temperature (YES in step S18), the control unit 40 stops additional heating of the recovery passage 302 by the heating unit 406 (step S19). On the other hand, in a case where the temperature of the recovery passage 302 is not equal to or higher than the predetermined temperature (NO in step S18), the control unit 40 heats the recovery passage 302 by the heating unit 406 (step S20).

In addition, in a case where the temperature of the base portion 246, which is acquired in step S2, is equal to or higher than the first setting temperature (YES in step S21), the control unit 40 stops additional heating of the base portion 246 by the heating unit 407 (step S22). On the other hand, in a case where the temperature of the base portion 246 is lower than the second temperature (YES in step S23), the control unit 40 heats the base portion 246 by the heating unit 407 (step S24). In addition, in a case where the temperature of the base portion 246 is equal to or higher than the second temperature, and is lower than the first setting temperature (NO in steps S21 and S23), the control unit 40 maintains an operation state of the heating unit 407.

The control unit 40 maintains a state of repeating the processes in steps S2 to S24 before the power of the inkjet recording apparatus 1 is turned off (NO in step S25). When the power of the inkjet recording apparatus 1 is turned off (YES in step S25), the process is terminated. On the other hand, in the temperature control relating to steps S3 to S24, the transition order of a configuration that becomes a target of the temperature control is set for convenience of explanation with reference to the flowchart, and there is no limitation to the description order in FIGS. 12 and 13. The transition order may be changed in an arbitrary manner, and the determination and the operation control on the heating unit may be simultaneously carried out with respect to a part or the entirety of the configurations.

On the other hand, although omitted in the description that has been made with reference to the flow, after the power of the inkjet recording apparatus 1 is turned on, the control unit 40 may control the operation of respective units so as not to carry out image formation corresponding to the printing job before the temperature of the respective units such as the storage section, the recording head 241, the first supply passage 3011, and the second supply passage 3012 which relate to the ejection of ink, reaches a temperature appropriate for ejection of ink.

Next, description will be given of operation of the inkjet recording apparatus 1 that is carried out during maintenance of the recording head 241.

The maintenance of the recording head 241 of the inkjet recording apparatus 1 is classified into ejection maintenance and reflow maintenance.

In the ejection maintenance, ink is ejected from the plurality of the nozzles N of the recording head 241 so as to eliminate clogging of the nozzles N.

In the reflow maintenance, ink inside the recording head 241 is allowed to reflow to the second storage section 243, and thus air bubbles mixed into the ink inside the recording head 241 is carried away to be removed from the inside of the recording head 241. A gas that is contained in the air bubble inside the ink which is removed from the inside of the recording head 241 flows to the second storage section 243, and is opened to a space inside the second storage section 243. As a result, the air bubbles in the ink disappear.

In this embodiment, maintenance of the recording head 241 is carried out in the order of the ejection maintenance and the reflow maintenance.

Figure 14:
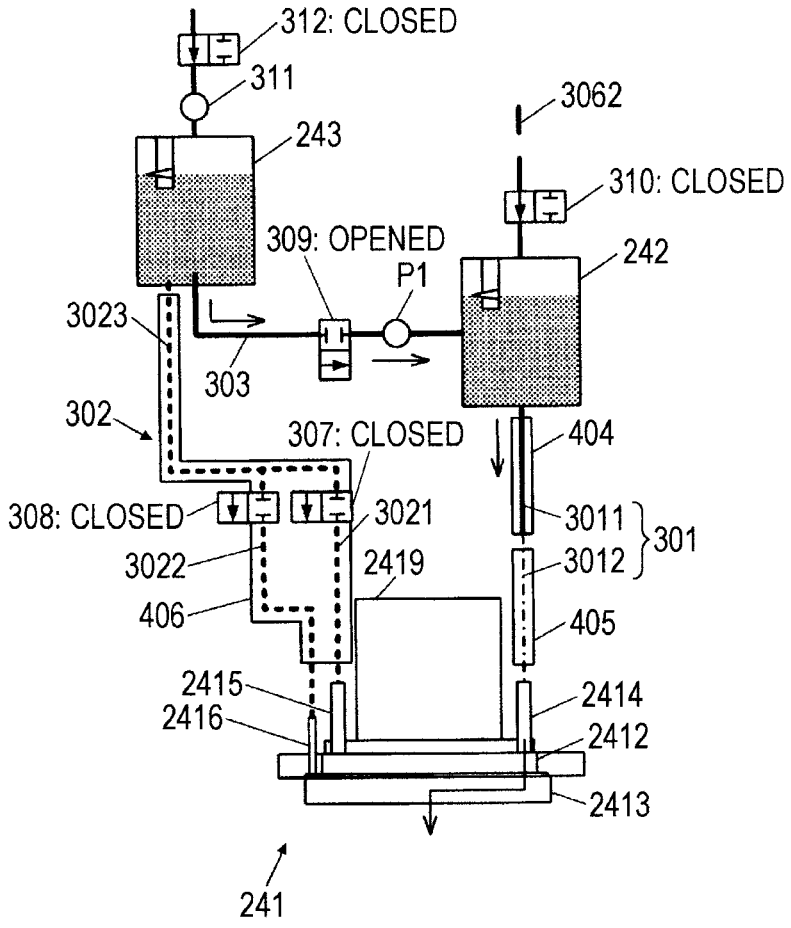
FIG. 14 is a view illustrating opening and closing of respective units and a flow of ink during ejection maintenance.

First, description will be given of operation of the inkjet recording apparatus 1 which is carried out during the ejection maintenance with reference to FIG. 14.

The control unit 40 closes connection between the first storage section 242 and the leakage prevention unit 305 by the electromagnetic valve 310. In addition, in a state in which the recovery passage 302 is closed by the electromagnetic valves 307 and 308, operation control of operating the pump P1 so as to supply ink stored in the second storage section 243 to the first storage section 242 is carried out. According to the operation control, ink stored in the second storage section 243 is supplied to the first storage section 242, and thus a pressure inside the first storage section 242 increases. At this time, since the connection between the first storage section 242 and the leakage prevention unit 305 is closed by the electromagnetic valve 310, gas entrance and exit with respect to the inside of the first storage section 242 is shut-off, and thus the pressure, which increases inside the first storage section 242, operates in a direction of extruding ink inside the first storage section 242 toward a recording head 241 side. At this time, since the recovery passage 302 is closed by the electromagnetic valves 307 and 308, ink extruded toward the recording head 241 side is ejected from the plurality of nozzles N. Since the ink is ejected from the plurality of nozzles N, even in a case where clogging of the nozzles N occurs, it is possible to solve the clogging. Accordingly, a failure in image formation due to the clogging is prevented, and thus it is possible to improve image quality.

On the other hand, the operation of respective electromagnetic valves, pumps, and the like during the ejection maintenance is carried out with respect to only an electromagnetic valve, a pump, and the like which correspond to the first storage section 242 to which the recording head 241 is connected as a target of the ejection maintenance.

In addition, the control unit 40 shuts off inflow of gas into the second storage section 243 by using the electromagnetic valve 312 before initiation of the ejection maintenance.

Specifically, the control unit 40 shuts off gas entrance and exit with respect to the inside of the second storage section 243 by closing a route that connects the pressure control unit 311 and a space in which outer air exists by using the electromagnetic valve 312.

Here, when ink stored in the second storage section 243 is supplied to the first storage section 242 during the ejection maintenance, if the electromagnetic valves 307, 308, and 312 enter a closed state, the pressure inside the second storage section 243 decreases in accordance with a decrease in the amount of ink inside the second storage section 243. On the other hand, the pump P1, which is provided between the second storage section 243 and the first storage section 242, has an output to a certain extent capable of sufficiently supplying ink from the second storage section 243 to the first storage section 242 regardless of the decrease in the pressure inside the second storage section 243 in accordance with the decrease in the amount of ink inside the second storage section 243.

The pressure inside the second storage section 243, which decreases in accordance with the ejection maintenance, is measured by the pressure detection unit 313.

Figure 15:
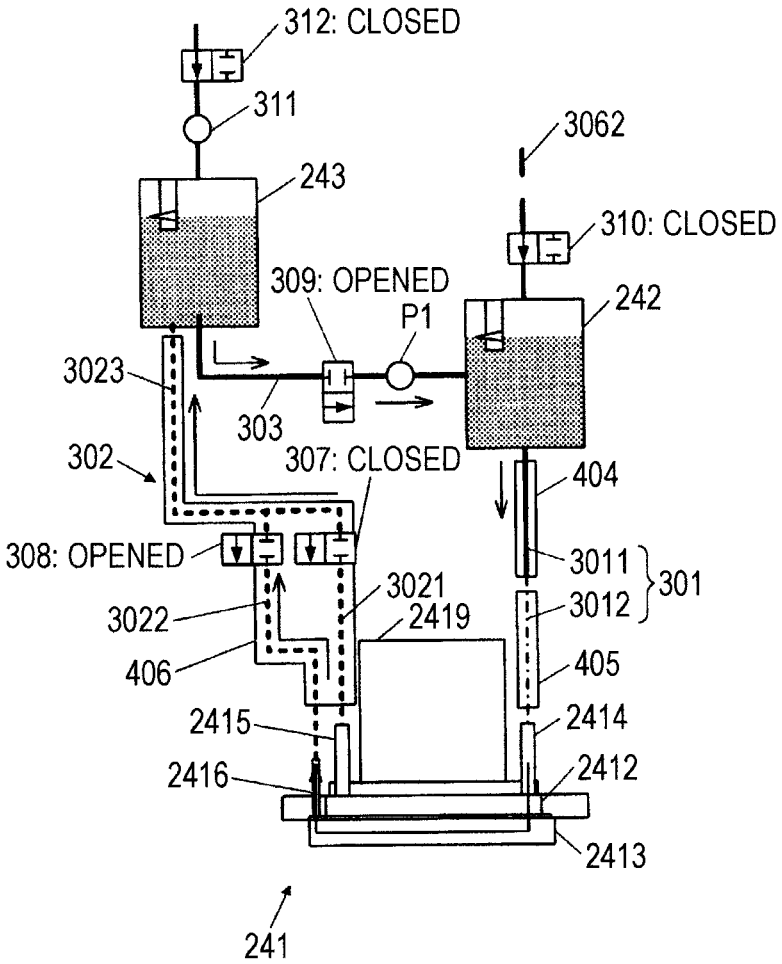
FIG. 15 is a view illustrating opening and closing of respective units and a flow of ink during reflow maintenance.

Next, description will be given of operation of the inkjet recording apparatus 1 which is carried out during the reflow maintenance with reference to FIG. 15.

First, the control unit 40 determines whether or not the pressure inside the second storage section 243 is measured by the pressure detection unit 313 as a pressure that is equal to or lower than a predetermined pressure. Here, for example, the predetermined pressure is a pressure represented by a unique pressure value (a predetermined pressure value) that is set in a range of −5 [kPa] to −30 [kPa].

Specifically, the control unit 40 acquires a pressure value inside the second storage section 243 which is measured by the pressure detection unit 313. In addition, the control unit 40 determines whether or not the acquired pressure value is equal to or lower than a predetermined pressure value.

In a case where the pressure inside the second storage section 243 is not equal to or lower than the predetermined pressure value, the control unit 40 operates the pressure control unit 311 to set the pressure inside the second storage section 243 to a pressure equal to or lower than the predetermined pressure.

Specifically, the control unit 40 opens the electromagnetic valve 312 for operation of the pressure control unit 311, and operates the pressure control unit 311 to decrease the pressure inside the second storage section 243, and continues acquisition of the pressure value inside the second storage section 243 from the pressure detection unit 313. Here, the control unit 40 continues the operation of the pressure control unit 311 until the pressure value acquired from the pressure detection unit 313 becomes equal to or lower than a predetermined pressure value. In a case where the pressure value is measured by the pressure detection unit 313 as a pressure value equal to or lower than the predetermined pressure value, the control unit 40 closes the electromagnetic valve 312 that is opened for the operation of the pressure control unit 311, and stops the operation of the pressure control unit 311, thereby performing control of maintaining the pressure inside the second storage section 243 which is equal to or lower than the predetermined pressure value before the recovery passage is opened. That is, the control unit 40 controls the operation of the pressure control unit 311 and the electromagnetic valve 312 to prevent an increase (for example, an increase from a pressure equal to or lower than a pressure equal to or lower than a predetermined pressure value to atmospheric pressure) in the pressure inside the second storage section 243 due to inflow of gas to the inside of the second storage section 243.

In a case where the pressure inside the second storage section 243 is equal to or lower than the predetermined pressure, the control unit 40 opens the recovery passage.

Specifically, for example, the control unit 40 opens the second recovery passage 3022 of the recording head 241, which is a target of the reflow maintenance, by using the electromagnetic valve 308. Here, the pressure inside the second storage section 243 is a negative pressure equal to or lower than the predetermined pressure. Accordingly, when the second recovery passage 3022 is opened, the negative pressure inside the second storage section 243 operates on ink inside the lower flow passage portion 2413 of the recording head 241 through the bypass portion 2416. That is, ink inside the lower flow passage portion 2413 can be pumped up into the second storage section 243. As a result, ink inside the lower flow passage portion 2413 reflows to the inside of the second storage section 243.

However, when the negative pressure inside the second storage section 243 is excessively higher, air may be taken-in from the nozzles N (this phenomenon is referred to as meniscus break). Whether or not air is taken-in from the nozzles N depends on flow passage resistance of the recovery passage 302, but in the reflow maintenance, it is necessary for the negative pressure to be set to a negative pressure at which the meniscus break is not caused. For example, as described above, if the ejection maintenance is carried out in advance, and the nozzles N are allowed to enter a pressurized state before carrying out the reflow maintenance, there is an advantage in that the meniscus break is less likely to occur.

As described above, the control unit 40 carries out first control (reflow maintenance) of supplying ink stored in the second storage section 243 to the first storage section 242 by using the supply unit (pump P1), and allowing ink inside the recording head 241 (for example, inside the lower flow passage portion 2413) to reflow to the second storage section 243 in a state in which gas entrance and exit with respect to the inside of the second storage section 243 is shut off by using the second switching unit (electromagnetic valve 312), gas entrance and exit with respect to the inside of the first storage section 242 is shut off by using the first switching unit (electromagnetic valve 310), and the recovery passage (for example, the second recovery passage 3022) is opened by using the third switching unit (electromagnetic valves 307 and 308). In addition, in this embodiment, the control unit 40 carries out the first control by opening the recovery passage (for example, the second recovery passage 3022) by using the third switching unit after carrying out second control (ejection maintenance) of supplying ink stored in the second storage section 243 to the first storage section 242 by using the supply unit (pump P1) and ejecting ink from the plurality of nozzles N of the recording head 241 in a state in which gas entrance and exit with respect to the inside of the second storage section 243 is shut off by the second switching unit (electromagnetic valve 312), gas entrance and exit with respect to the inside of the first storage section 242 is shut off by using the first switching unit (electromagnetic valve 310), and the recovery passage 302 is closed by using the third switching unit (electromagnetic valves 307 and 308).

On the other hand, the operation of the respective electromagnetic valves, pumps, and the like during the reflow maintenance is carried out with respect to only an electromagnetic valve, a pump, and the like which correspond to the recording head 241 that becomes a target of the reflow maintenance.

Since ink inside the lower flow passage portion 2413 can be allowed to reflow to the second storage section 243 through the reflow maintenance, even in a case where air bubbles are mixed into the ink inside the lower flow passage portion 2413, it is possible to remove the air bubbles by allowing the ink to reflow. Accordingly, it is possible to prevent a failure in image formation, and thus it is possible to improve image quality.

In addition, when the reflow maintenance is carried out after the ejection maintenance, it is possible to release a part of the pressure of ink, which is transferred to the recording head 241 from the first storage section 242 to the recording head 241, toward a second storage section 243 side, and thus it is possible to rapidly decrease the pressure on the ink which increases inside the first storage section 242 and the recording head 241. For example, when the reflow maintenance is carried out after passage of time (for example, approximately 1 [second] to 3 [seconds]) for ejection of ink from the plurality of nozzles N so as to solve the clogging of the plurality of nozzles N during the ejection maintenance, it is possible to rapidly terminate ejection of ink from the plurality of nozzles N, and thus it is possible to prevent ink from being uselessly ejected.

In addition, in the inkjet recording apparatus 1, with regard to supply of ink to the recording head 241 during the reflow maintenance, ink supplied to the first storage section 242 by the pump P1 is stored once in the first storage section 242, and thus a pressure, which is directly applied to ink due to operation of the pump P1, is diffused at the point of time at which ink is stored in the first storage section 242, and is greatly mitigated. That is, when ink is fed to the recording head 241 through the first storage section 242, the pressure, which is applied to ink due to the pump P1, may be indirect, and thus it is possible to smoothly supply ink to the recording head 241 in a constant manner without unevenness.

On the other hand, reflow maintenance carrying-out time can be set in an arbitrary manner.

For example, the reflow maintenance carrying-out time, which is capable of sufficiently removing air bubbles in the ink inside the recording head 241, is derived through an experiment and the like, and the derived time may be set as the reflow maintenance carrying-out time. In addition, for example, the reflow maintenance may be continuously carried out until the pressure inside the second storage section 243 becomes approximately the same as that of outside air. In this case, time, which is taken until the pressure inside the second storage section 243 becomes approximately the same as the pressure of the outside air, is equal to or longer than the reflow maintenance carrying-out time capable of sufficiently removing air bubbles in ink inside the recording head 241. On the other hand, in a case where time, which is taken until the pressure inside the second storage section 243 becomes approximately the same as the pressure of outside air, is shorter than the reflow maintenance carrying-out time capable of sufficiently removing air bubbles in ink inside the recording head 241, the reflow maintenance is carried out a plurality of times to sufficiently remove air bubbles in ink inside the recording head 241. In a case where the reflow maintenance is carried out a plurality of times, with regard to the reflow maintenance from second time, the ejection maintenance may be omitted, and the reflow maintenance may be carried out in accordance with a decrease in pressure inside the second storage section 243 by the pressure control unit 311. In addition, for example, in a case where the nozzles N are not clogged, and thus it is not necessary to carry out the ejection maintenance, the ejection maintenance may be omitted, and the reflow maintenance may be carried out in accordance with a decrease in pressure inside the second storage section 243 by the pressure control unit 311.

In addition, maintenance initiation conditions may be set in an arbitrary manner. Examples of the initiation conditions includes a case where an instruction of maintenance initiation is given from a user through the operation display unit 80, or a case where predetermined conditions is satisfied in the inkjet recording apparatus 1. Examples of the case where the predetermined conditions are satisfied include a case where image formation is carried out with respect to the recording medium P in the amount equal to or greater than a predetermined amount, a case where a predetermined elapsed time has passed from final image formation, and the like.

During maintenance, the control unit 40 moves the head unit 24 to a position on a cleaning unit 27 side through the carriage control unit 245, and then carries out the maintenance.

Figure 16:
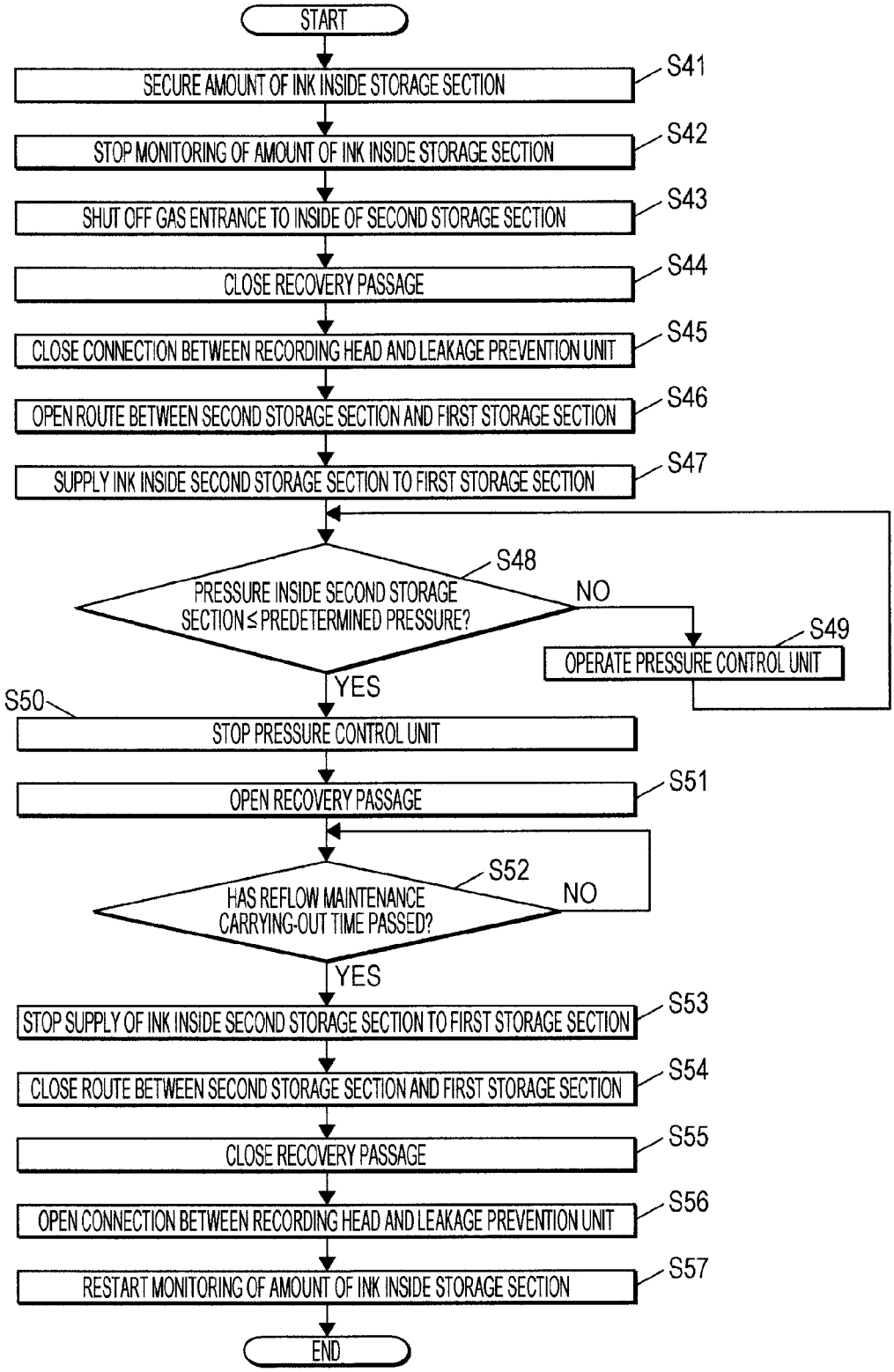
FIG. 16 is a flowchart illustrating an example of an operation control flow relating to maintenance.

Next, description will be given of operation control relating to the maintenance with reference to flowcharts of FIG. 16.

First, the control unit 40 carries out a process relating to securement of the amount of ink inside the storage section (step S41). Specifically, the control unit 40 detects the residual amount of ink in the first storage section 242 and the second storage section 243 by using the liquid surface sensors 2421 and 2431, and in a case where the residual amount of ink which is detected is deficient, the control unit 40 supplies ink to a storage section in which the residual amount of ink is deficient.

Next, the control unit 40 stops monitoring of the amount of ink inside the storage section (step S42). Specifically, the control unit 40 stops the control relating to the amount of ink in the first storage section 242 and the second storage section 243 in accordance with the amount of ink in the first storage section 242 and the second storage section 243 which is detected by the liquid surface sensors 2421 and 2431.

Next, the control unit 40 shuts off inflow of gas into the second storage section 243 by using the electromagnetic valve 312 (step S43). Specifically, the control unit 40 closes a route that connects the pressure control unit 311 and a space in which outer air exists by using the electromagnetic valve 312, thereby closing the route that connects the second storage section 243 and the space in which outer air exists through the pressure control unit 311.

In addition, the control unit 40 closes the recovery passage 302 by using the electromagnetic valves 307 and 308 (step S44).

In addition, the control unit 40 closes connection between the recording head 241 and the leakage prevention unit 305 by using the electromagnetic valve 310 (step S45). The processes in steps S43 to S45 are executed in the above-described order.

Next, the control unit 40 opens the route 303 between the second storage section 243 and the first storage section 242 by using the electromagnetic valve 309 (step S46), and operates the pump P1 to supply ink stored in the second storage section 243 to the first storage section 242 (step S47), thereby carrying out the ejection maintenance.

After the process in step S47, the control unit 40 determines whether or not the pressure inside the second storage section 243 is measured by the pressure detection unit 313 as a pressure equal to or lower than the predetermined pressure (step S48). Here, in a case where it is determined that the pressure inside the second storage section 243 is equal to or lower than the predetermined pressure (NO in step S48), the control unit 40 opens the electromagnetic valve 312 for operation of the pressure control unit 311, and operates the pressure control unit 311 (step S49), thereby decreasing the pressure inside the second storage section 243. Then, the process transitions to the process in step S48. The control unit 40 continues the operation of the pressure control unit 311 until it is determined in step S48 that the pressure inside the second storage section 243 is equal to or lower than the predetermined pressure.

In a case where it is determined that the pressure inside the second storage section 243 is equal to or lower than the predetermined pressure (YES in step S48), the control unit 40 closes the electromagnetic valve 312 that is opened for the operation of the pressure control unit 311, and stops the operation of the pressure control unit 311 (step S50). Then, the control unit 40 opens the recovery passage 302 (step S51) to carryout the reflow maintenance. Specifically, for example, the control unit 40 opens the second recovery passage 3022 by using the electromagnetic valve 308.

After the process in step S51, in a case where it is determined that the reflow maintenance carrying-out time has passed (YES in step S52), the control unit 40 stops the operation of the pump P1 to stop supply of ink from the second storage section 243 to the first storage section 242 (step S53). In addition, the control unit 40 closes the route 303 between the second storage section 243 and the first storage section 242 by using the electromagnetic valve 309 (step S54) and closes the recovery passage 302 (step S55), thereby terminating the maintenance. In addition, the control unit 40 opens connection between the recording head 241 and the leakage prevention unit 305 by using the electromagnetic valve 310 (step S56).

Then, the control unit 40 restarts the monitoring of the amount of ink inside the storage section (step S57), and terminates the process.

As described above, according to the inkjet recording apparatus 1 of this embodiment, the control unit 40 carries out the first control (reflow maintenance) of shutting off the gas entrance and exit with respect to the inside of the second storage section 243 by using the electromagnetic valve 312, shutting off the gas entrance and exit with respect to the inside of the first storage section 242 by using the electromagnetic valve 310, opening the recovery passage 302 (for example, the second recovery passage 3022) by using the electromagnetic valves 307 and 308, supplying ink stored in the second storage section 243 to the first storage section 242 by using the pump P1, and allowing ink inside the recording head 241 to reflow to the second storage section 243. As a result, it is possible to generate a suction force in a direction facing the inside of the second storage section 243 due to a decrease in the pressure inside the second storage section 243 through supply of ink stored in the second storage section 243 to the first storage section 242. The suction force operates as a force of guiding ink inside the recording head 241 toward the second storage section 243 through the recovery passage 302 that is opened, and thus it is possible to more effectively carry out the reflow maintenance in comparison to the related art in which ink inside the recording head 241 is allowed to face the recovery passage 302 by a pressure on the ink inside the recording head 241. In addition, the suction force does not operate as a force of ejecting ink from the nozzles N of the recording head 241 differently from the pressure. Accordingly, it is possible to reduce waste of ink due to ejection of ink from the nozzles N during the reflow maintenance which occurs in the related art due to the pressure, and thus it is possible to carry out the reflow maintenance in a more effective manner.

In addition, in a state in which the recovery passage 302 is closed by the electromagnetic valves 307 and 308, the second control (ejection maintenance) of supplying ink, which is stored in the second storage section 243 by the pump P1, to the first storage section 242 and ejecting ink from the plurality of nozzles N of the recording head 241 is carried out, and then the first control is carried out by opening the second recovery passage 3022 by using the electromagnetic valve 308. Accordingly, it is possible to use a decrease in ink inside the second storage section 243 in accordance with consumption of ink for solving the clogging of the nozzles N under the second control for a decrease in the pressure inside the second storage section 243, and thus it is possible to carry out the reflow maintenance with a relatively stronger suction force, and thus it is possible to carry out the reflow maintenance in a more effective manner.

In addition, the inkjet recording apparatus 1 includes the pressure control unit 311 that discharges gas inside the second storage section 243 in order for the inside of the second storage section 243 to enter a negative pressure state, and the control unit 40 allows the inside of the second storage section 243 to enter the negative pressure state by using the pressure control unit 311 before carrying out the first control (reflow maintenance). Accordingly, it is possible to generate the suction force in the second storage section 243 in a more reliable manner, and thus it is possible to carry out the reflow maintenance in a more effective manner.

In addition, the gas entrance and exit with respect to the inside of the second storage section 243 is opened by using the electromagnetic valve 312 in accordance with the operation of the pressure control unit 311, but the gas entrance and exit is shut off simultaneously with stoppage of the operation of the pressure control unit 311, and thus it is possible to carry out the reflow maintenance under conditions in which the pressure inside the second storage section 243 is maintained to the negative pressure state.

In addition, the inkjet recording apparatus 1 includes the pressure detection unit 313 that measures the pressure inside the second storage section 243, and in a case where the pressure inside the second storage section 243 is measured by the pressure detection unit 313 as a pressure equal to or lower than the predetermined pressure, the control unit 40 carries out the first control (reflow maintenance). Accordingly, it is possible to more reliably generate the suction force that is sufficient for carrying-out of the reflow maintenance due to the negative pressure inside the second storage section 243 which is equal to or lower than the predetermined pressure, and thus it is possible to carry out the reflow maintenance in a more effective manner.

In addition, the predetermined pressure is set in a range of −5 [kPa] to −30 [kPa], and thus it is possible to generate the suction force that is sufficient for carrying-out of the reflow maintenance in a more reliable manner, and thus it is possible to carry out the reflow maintenance in a more effective manner.

In addition, in the inkjet recording apparatus 1 that uses ink of which a phase varies in accordance with a temperature, as described above, the temperature of the recording head 241, the storage section, the first supply passage 3011, the second supply passage 3012, and the like is controlled, and thus it is possible to realize a liquid phase that is optimal for ejection of ink inside the recording head 241.

In addition, the plurality of nozzles N is provided in a number corresponding the maximum width of the recording medium P in a direction perpendicular to a direction in which the recording head 241 and the recording medium P relatively move during image formation, and thus it is possible to employ a one pass type capable of forming an image without relatively moving the image forming drum 21 and the recording head 241 in the width direction during image formation. Accordingly, it is possible to form an image at a relatively higher speed, and thus it is possible to provide the inkjet recording apparatus 1 with relatively higher productivity.

In addition, the setting temperature of the first supply passage 3011 and the second supply passage 3012 is lower than the setting temperature of the recording head 241, and thus it is possible to prevent the temperature of the recording head 241 from being excessively raised due to flowing of the ink, which is heated to a relatively higher temperature, from the storage section directly into the recording head 241. Accordingly, it is possible to prevent the recording head 241 from being overheated. In addition, the setting temperature of the second supply passage 3012 is set to be higher than the setting temperature of the first supply passage 3011, and thus it is possible to make the temperature of ink, which is lowered once at the first supply passage 3011, be close to a temperature optimal for the recording head 241 at the second supply passage 3012. Accordingly, it is possible to easily maintain the temperature of the recording head 241 to a desired temperature. As a result, it is possible to maintain the temperature of the recording head 241 to a more appropriate temperature, and it is possible to carry out ejection of ink in a satisfactory manner.

On the other hand, the embodiment disclosed here is illustrative only in all aspects, and embodiments of the invention are not limited thereto. The scope of the invention is represented by the accompanying claims rather than the above description, and is intended to include meaning equivalent to the accompanying claims and all modifications in the scope.

For example, the inkjet recording apparatus 1 may further include a measuring unit that measures the amount of ink ejected from the plurality of nozzles N of the recording head 241, and in a case where the amount of ink measured by the measuring unit in a predetermined unit time is greater than a predetermined amount, the control unit 40 may lower the setting temperature of the second supply passage 3012.

In addition, the inkjet recording apparatus 1 may further include a measuring unit that measures the amount of ink ejected from the plurality of nozzles N of the recording head 241, and in a case where the amount of ink measured by the measuring unit in a predetermined unit time is greater than a predetermined amount, the control unit 40 may raise the setting temperature of the storage section.

In addition, in a case where the amount of ink measured by the measuring unit in a predetermined unit time is greater than a predetermined amount, the setting temperature of the second supply passage 3012 may be lowered, and the setting temperature of the storage section may also be raised.

Specifically, for example, in a case where a printing rate is greater than a predetermined value (for example, 60[%]), this case is regarded as a case where the amount of ink ejected in the predetermined unit time is measured as an amount equal to or greater than the predetermined amount. In this case, the setting temperature of the second supply passage 3012 is set to be lower than as in the case where the amount of ink ejected in the predetermined unit time is equal to or less than the predetermined amount, or the setting temperature of the storage section is set to be higher than as in the above-described case.

Figure 17:
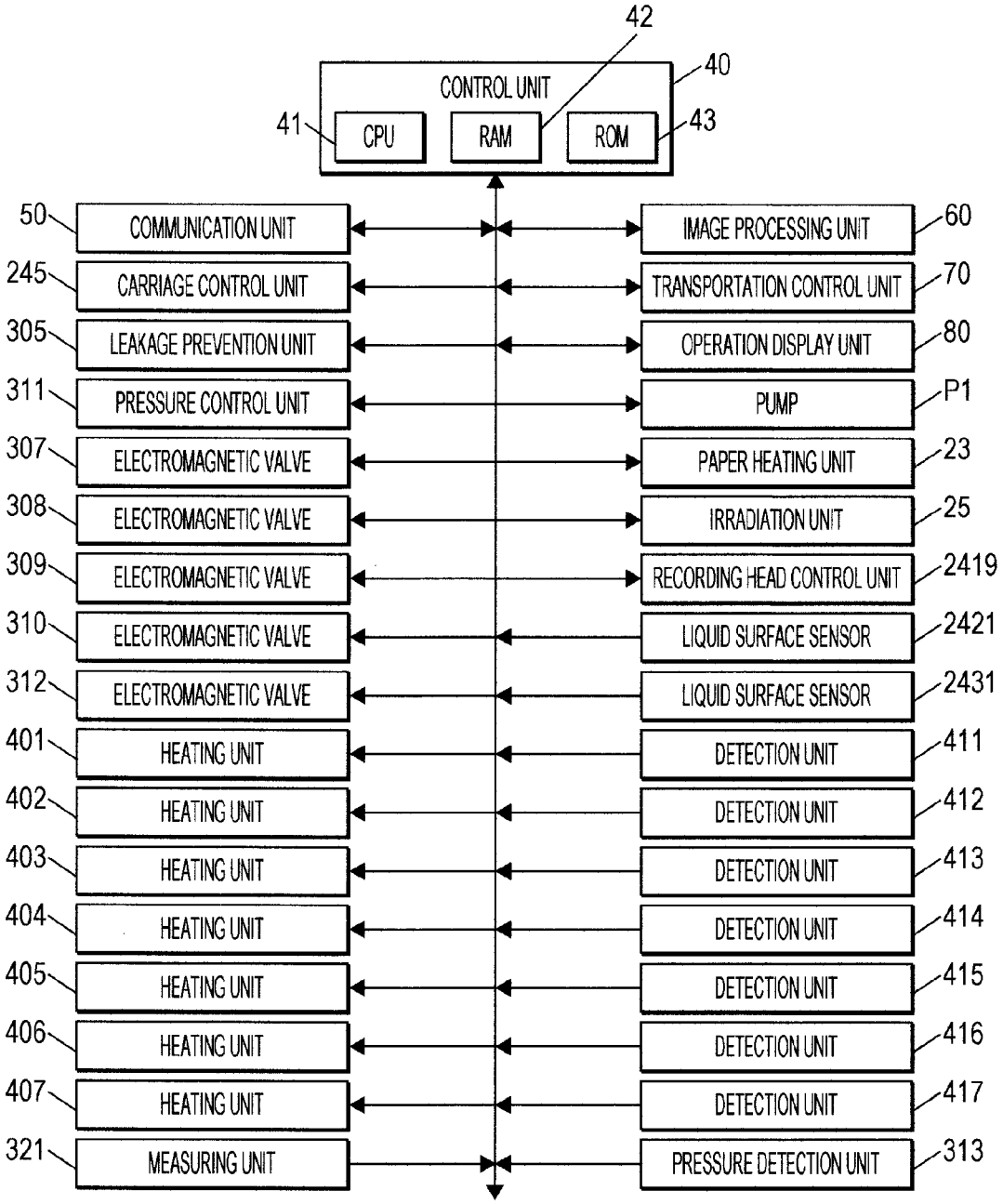
FIG. 17 is a block diagram of an inkjet recording apparatus that further includes a measuring unit.

On the other hand, measurement of the printing rate is carried out by measuring the percentage of the number of the nozzles N, which are driven in the predetermined unit time in accordance with a printing job, among the plurality of nozzles N of the recording head 241, or the amount of ink ejected from the nozzles which are driven. Specifically, for example, as illustrated in FIG. 17, a measuring unit 321 is provided. The measuring unit 321 calculates the printing rate by measuring a drive signal of the nozzles N which is transmitted to each of the recording heads 241 in accordance with a printing job, or the ejection amount of ink which is indicated by the drive signal. The control unit 40 controls the setting temperature of the second supply passage 3012 or the storage section in accordance with the printing rate that is calculated by the measuring unit 321.

Table 8 illustrates a specific example of temperature control in a case where the printing rate is greater than a predetermined value (for example, 60[%]). On the other hand, Table 7 is a specific example of temperature control in a case where the printing rate is equal to or less than the predetermined value (for example, 60[%]).

For example, as Examples (11) to (13) in Table 8, it is possible to maintain the temperature of ink inside the recording head 241 in an approximately constant manner as illustrated in a case of a printing rate of 90[%] in FIG. 11 by controlling the operation of the temperature changing unit (for example, the heating unit 405) to further lower the setting temperature of the second supply passage 3012 in comparison to Examples (1) to (3) in Table 7 so as to reach the setting temperature.

In addition, similarly to Examples (11) and (12) in Table 8, if the operation of the temperature changing unit (for example, the heating units 402 and 403) is controlled to further raise the temperature of the storage section so as to reach the setting temperature in comparison to Examples (1) and (2) in Table 7, even in a case where the ejection amount of ink from the recording head 241 more increases, and thus a supply frequency of ink to the recording head 241 increases, and a supply frequency of ink before being heated to the second storage section 243 increases, it is possible to sufficiently liquefy ink at the storage section. On the other hand, with regard to the temperature of the storage section, Example (13) and Example (3) are similar to each other, but the reason for this is as follows regardless of the printing rate. Specifically, the temperature (75 [C]) of the storage section is sufficiently higher than the first temperature 50 [C] of ink, and thus liquefaction of ink is sufficient before the ink is supplied from the storage section to the first supply passage 3011.

TABLE 8

| | | Temperature [C.] | | | | | Temperature [C.] | |
|---|---|---|---|---|---|---|---|---|
| Printing rate of 60% or less | | Storage section | First supply passage | Second supply passage | Recording head | Ejection | Kind of ink | First temperature [C.] |
| Examples | (11) | 85 | 63 | 65 | 70 | ○ | i | 63 |
| | (12) | 93 | 78 | 80 | 85 | ○ | ii | 78 |
| | (13) | 75 | 52 | 56 | 65 | ○ | iii | 50 |

In a case where the amount of ink ejected in the predetermined unit time is measured by the measuring unit 321 as an amount equal to or greater than the predetermined amount, when the setting temperature of the second supply passage 3012 is lowered, and the supply frequency of ink from the storage section to the recording head 241 is raised, time for which ink transported from the storage section residues in the first supply passage 3011 is relatively shortened. Accordingly, even in a case where time for which a temperature of ink is lowered in the first supply passage 3011 is shortened, the temperature of the second supply passage 3012 is relatively lower, and thus it is possible to lower the temperature of ink. Accordingly, even in a case where the amount of ink ejected in the predetermined unit time is greater than the predetermined amount, it is possible to set the temperature of ink to be supplied to the recording head 241 through the first supply passage 3011 and the second supply passage 3012 to an appropriate temperature in a more reliable manner.

In addition, in a case where the amount of ink ejected in the predetermined unit time is measured by the measuring unit 321 as an amount equal to or greater than the predetermined amount, if the setting temperature of the storage section is raised, even in a situation in which the amount of ink consumed is relatively greater, and thus the supply frequency of ink before being heated to the storage section is relatively higher, it is possible to liquefy the ink in a more reliable manner.

On the other hand, the predetermined unit time can be set as an arbitrary time, but when being set as a unit time capable of corresponding to an increase in the supply frequency of ink to the recording head 241 which occurs due to an increase in the ejection amount of ink from the recording head 241, it is possible to carry out appropriate temperature control in accordance with a measurement result relating to an ejection amount of ink.

In addition, the method of setting the inside of the second storage section 243 to the negative pressure can be appropriately changed.

For example, in a case where the ejection maintenance and the reflow maintenance are always carried out in a set, and it is confirmed that a negative pressure sufficient for carrying-out of the reflow maintenance can be generated in the second storage section through carrying-out of the ejection maintenance, the pressure control unit 311 may not be provided. In this case, the processes such as measurement of the pressure inside the second storage section 243 by using the pressure detection unit 313, comparison between the measured pressure inside the second storage section 243 and the predetermined pressure and determination thereof, and the process of setting the pressure inside the second storage section 243 to a pressure equal to or lower than the predetermined pressure are omitted.

In addition, in Examples described above, ink in which phase transition occurs in accordance with a temperature of ink is used, but the ink is illustrative only, and can be appropriately changed. The ink can be employed to the inkjet recording apparatus according to the invention as long as the ink becomes a liquid phase appropriate for ejection at a temperature equal to or lower than the upper limit temperature.

In addition, in Examples described above, only the second recovery passage 3022 is opened during reflow maintenance. However, this configuration is illustrative only, the first recovery passage 3021 can be set to be opened, or both of the first recovery passage 3021 and the second recovery passage 3022 may be set to be opened without limitation to the above-described configuration.

In addition, in Examples described above, the heating units 401 to 407 function as the temperature changing unit, but this is illustrative only, and there is no limitation thereto. For example, as the temperature changing unit, a plurality of cooling units, which are individually provided to the recording head 241, the storage section, the supply passage 301, the recovery passage 302, and the base portion 246, and which changes the temperature thereof through cooling-down, may be provided in addition to the heating units 401 to 407. Examples of the cooling unit include various configurations and the like for water-cooling in addition to a fan and a heat sink for wind-cooling.

In addition, the temperature changing unit may be provided in such a manner that both heating and cooling are possible. For example, this temperature changing unit is realized by employing a Peltier element and a configuration of switching polarity of a current flowing to the Peltier element.

In addition, the recovery passage 302 may not be diverged and joined.

Figure 18:
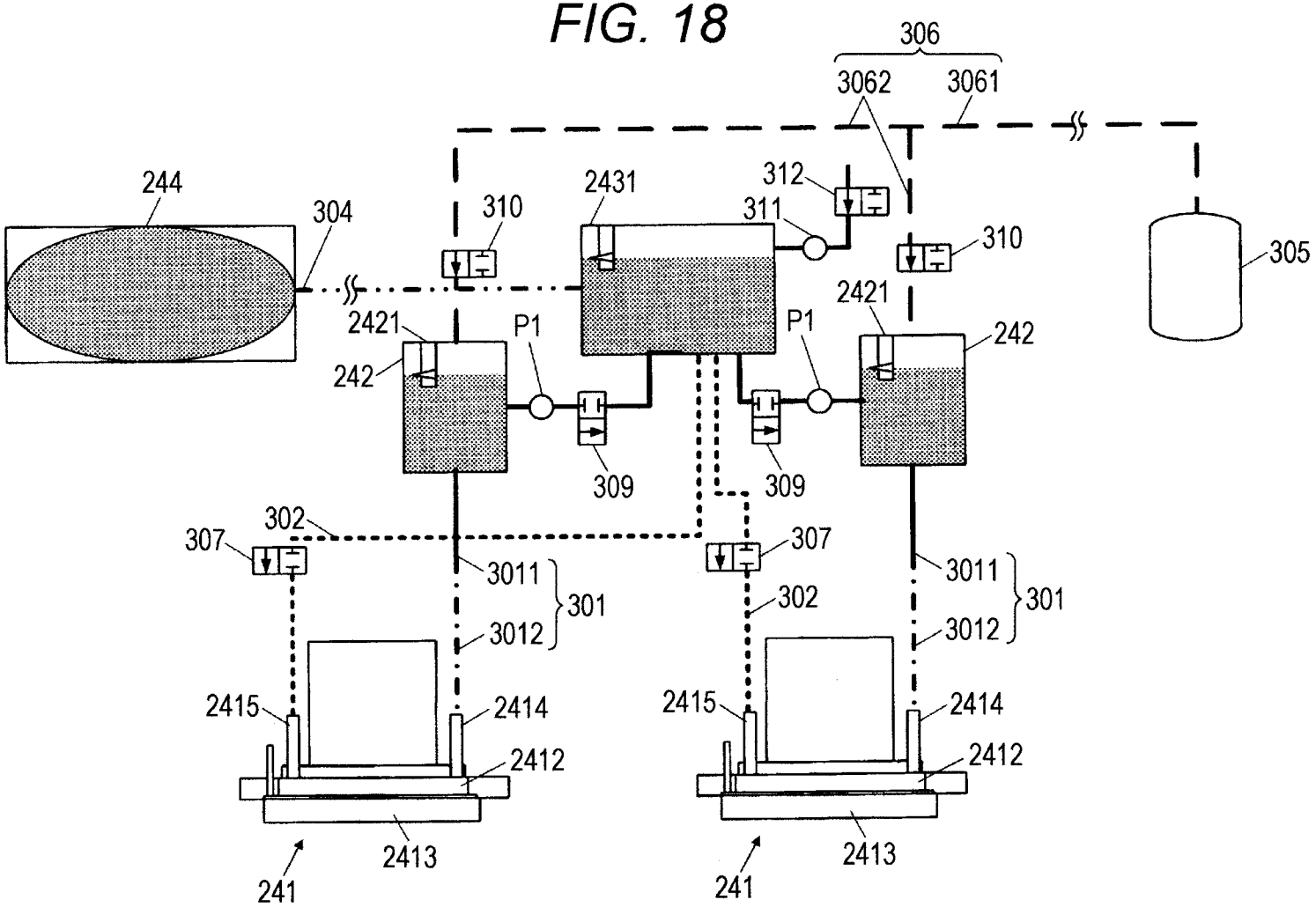
FIG. 18 is a view illustrating an example in which a recovery passage is a single route.

FIG. 18 is a view illustrating an example in which the recovery passage 302 is a single route.

In the example illustrated in FIG. 18, connection between the bypass portion 2416 and the second storage section 243 is omitted, and the discharge hole 2415 and the second storage section 243 are connected to each other by the recovery passage 302 that is a single route. In this case, the portion, at which the bypass portion 2416 is provided in the embodiment, is closed, and thus ink is not leaked to the outside. On the other hand, in FIG. 18, connection between the bypass portion 2416 and the second storage section 243 is omitted, and the discharge hole 2415 and the second storage section 243 are connected to each other by the recovery passage 302 that is a single route, but a reverse configuration is also possible. Specifically, connection between the discharge hole 2415 and the second storage section 243 may be omitted, and the bypass portion 2416 and the second storage section 243 may be connected to each other by the recovery passage 302 that is a single route.

On the other hand, in FIG. 18, the temperature changing unit (heating units 404, 405, and 406) is not illustrated, but the temperature changing unit is also provided in the same manner as in the above-described embodiment.

In addition, in Examples described above, one recording head 241 is connected to one first storage section 242, but this configuration is illustrative only, and there is no limitation thereto. A plurality of the recording heads 241 may be connected to the one first storage section 242.

Figure 19:
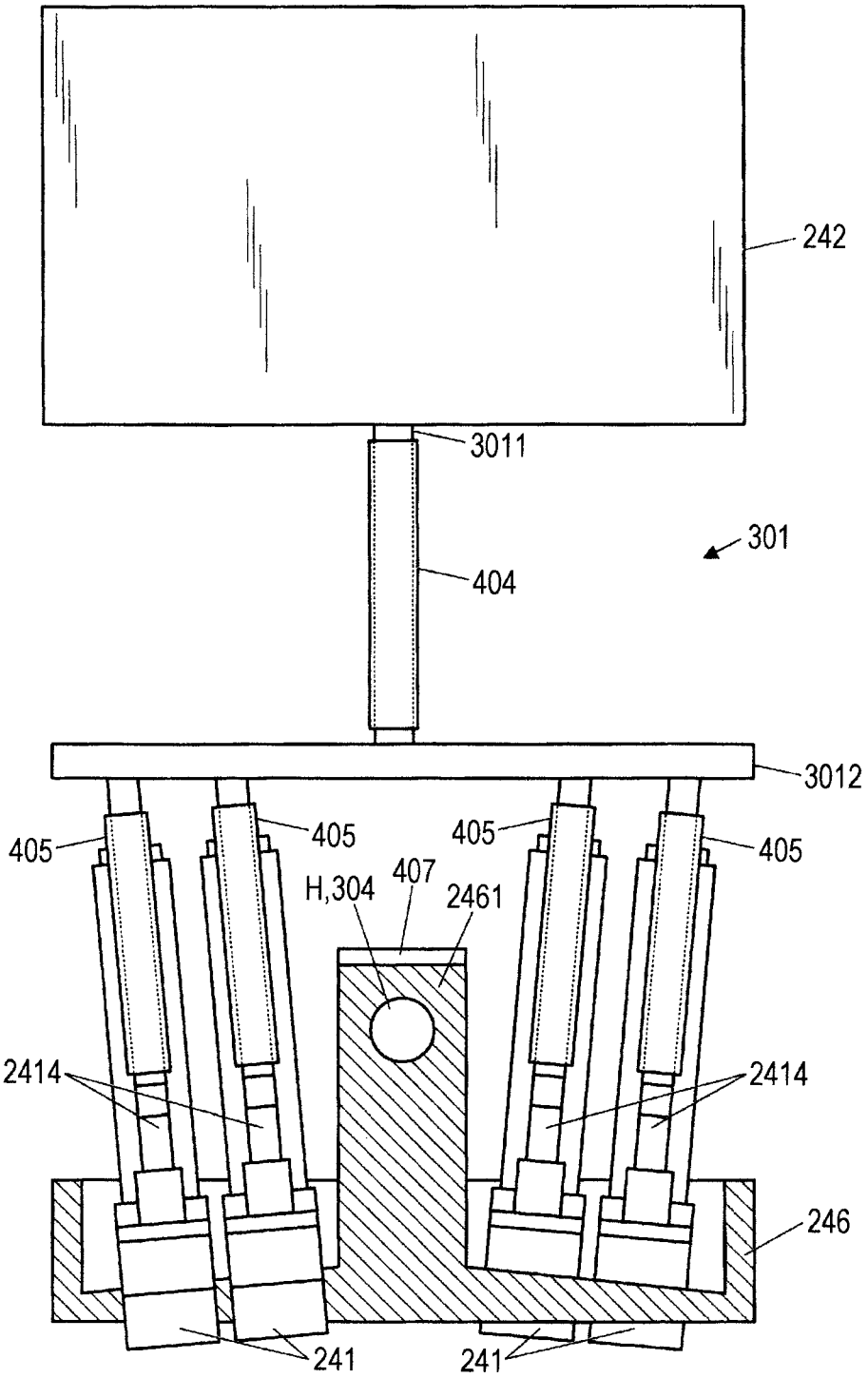
FIG. 19 is a view illustrating an example of structures of a first supply passage and a second supply passage in a case where a plurality of recording heads is connected to one first storage section.

Specifically, for example, as illustrated in FIG. 19, in the supply passage 301, a supply passage, which is connected to the first storage section 242 and is shared with the plurality of recording heads 241, may be set as the first supply passage 3011, and a supply passage, which is provided to be diverged from the first supply passage to the plurality of recording heads 241, may be set as the second supply passage 3012. In this case, it is possible to communize the configuration relating to the temperature control of the first supply passage 3011 in accordance with the number of the recording heads 241 which share the first supply passage 3011. On the other hand, in a case where the plurality of recording heads 241 is connected to the one first storage section 242, the ejection maintenance is collectively carried out with respect to the plurality of recording heads 241.

In addition, in the configuration illustrated in FIG. 17, the measuring unit 321 is independently provided, but this is illustrative only, and there is no limitation thereto. For example, the control unit 40 may also function as the measuring unit 321.

Similarly, various control units illustrated in the block diagram may be independent hardware, or an information processing device that is provided to function as a part or the entirety of the various control units through software processing.

In addition, a relationship between the number of the plurality of nozzles N which are provided to the plurality of recording heads 241 which are provided to the head unit 24 in the above-described embodiment, and the width of the recording medium P is illustrative only, and can be appropriately changed. In the above-described inkjet recording apparatus 1, the plurality of recording heads 241 is provided to the head unit 24, but for example, a single recording head 241 is also possible. In addition, with regard to the inkjet recording apparatus of the one pass type, the single recording head 241 may include the plurality of nozzles N in a number corresponding to the maximum width of the recording medium P in a direction perpendicular to a direction in which the recording head 241 and the recording medium P are relatively moved during image formation.

In addition, the temperature changing unit or the detection unit may be provided to each unit in a plural number. For example, each operation of a plurality of heating units, which are partitioned to a plurality of divisions along an extension direction of the first supply passage 3011 or the second supply passage 3012, may be configured to be individually controlled. In this case, a detection unit is individually provided at a position corresponding to each of the divisions, and thus a temperature measured by each of the detection units and the operation of the heating unit correspond to each other. This is also true of other configurations in which the temperature changing unit or the detection unit is provided.

In addition, in Examples described above, the electromagnetic valve 312, which is provided in a gas flow passage that is connected from the second storage section 243 to a space outside the second storage section 243 through the pressure control unit 311, functions as the second switching unit, but this configuration is illustrative only, and there is no limitation thereto.

For example, in the second storage section 243, the second switching unit (for example, an electromagnetic valve) may be provided in a gas flow passage which is provided separately from the gas route relating to the connection between the second storage section 243 and the pressure control unit 311, and connects spaces inside and outside the second storage section 243.

In addition, in the ink ejection mechanism 300, a degassing device configured to remove gas, which is dissolved in liquefied ink, may be provided.

INDUSTRIAL APPLICABILITY

The invention can be used in an inkjet recording apparatus, and a recording head maintenance method.

REFERENCE SIGNS LIST

1: Inkjet recording apparatus
20: Image forming section
40: Control unit
241: Recording head
242: First storage section
243: Second storage section
244: Ink tank
246: Base portion
301: Supply passage
3011: First supply passage
3012: Second supply passage
302: Recovery passage
305: Leakage preventing unit
307, 308: Electromagnetic valve (third switching unit)
310: Electromagnetic valve (first switching unit)
312: Electromagnetic valve (Second switching unit)
311: Pressure control unit
313: Pressure detection unit
321: Measuring unit
401, 402, 403, 404, 405, 406, 407: Heating unit
411, 412, 413, 414, 415, 416, 417: Detection unit
N: Nozzle
P1: Pump (supply unit)

The invention claimed is:

1. An inkjet recording apparatus comprising:

a recording head that includes a plurality of nozzles through which ink is ejected to a recording medium to form an image;

a first storage section that stores ink to be supplied to the recording head;

a supply passage which is provided to connect the recording head and the first storage section, and through which ink supplied from the first storage section to the recording head passes;

a first switching unit that switches opening or shut-off of gas entrance and exit with respect to the inside of the first storage section;

a second storage section that stores ink to be supplied to the first storage section;

a supply unit that supplies the ink stored in the second storage section to the first storage section;

a second switching unit that switches opening or shut-off of gas entrance and exit with respect to the inside of the second storage section;

a recovery passage which is provided to connect the recording head and the second storage section, and through which a part of the ink supplied to the recording head passes and is returned to the second storage section;

a third switching unit that switches opening and closing of the recovery passage; and a control unit that controls operation of the first switching unit, the second switching unit, the third switching unit, and the supply unit, wherein the control unit carries out a maintenance process comprising:

first control of shutting off the gas entrance and exit with respect to the inside of the second storage section by using the second switching unit, shutting off the gas entrance and exit with respect to the inside of the first storage section by using the first switching unit, opening the recovery passage by using the third switching unit, supplying the ink stored in the second storage section to the first storage section by using the supply unit, and allowing ink inside the recording head to reflow to the second storage section, second control of supplying the ink stored in the second storage section to the first storage section by using the supply unit, and ejecting the ink from the plurality of nozzles of the recording head in a state in which the gas entrance and exit with respect to the inside of the second storage section is shut off by the second switching unit, and the gas entrance and exit with respect to the inside of the first storage section is shut off by the first switching unit, and the recovery passage is closed by the third switching unit, and after carrying out the second control, the control unit again carries out the first control before termination of the maintenance process by opening the recovery passage by using the third switching unit.

2. The inkjet recording apparatus according to claim 1, further comprising:

a pressure control unit that allows the inside of the second storage section to enter a negative pressure state by discharging gas inside the second storage section, wherein the second switching unit is provided to a gas flow passage that is connected to a space outside the second storage section from the second storage section through the pressure control unit, and the control unit opens the gas entrance and exit with respect to the inside of the second storage section by using the second switching unit, and allows the inside of the second storage section to enter the negative pressure state by using the pressure control unit before carrying out the first control.

3. The inkjet recording apparatus according to claim 1, further comprising:

a pressure detection unit that measures a pressure inside the second storage section, wherein the control unit carries out the first control in a case where the pressure inside the second storage section is measured by the pressure detection unit as a pressure equal to or lower than a predetermined pressure.

4. The inkjet recording apparatus according to claim 3, wherein the predetermined pressure is set in a range of −5 [kPa] to −30 [kPa].

5. The inkjet recording apparatus according to claim 1, wherein a phase of the ink is changed between a gel phase or a solid phase and a liquid phase in accordance with a temperature.

6. The inkjet recording apparatus according to claim 1, wherein the plurality of nozzles is provided in a direction perpendicular to a direction, in which the recording head and the recording medium are relatively moved during formation of an image, in a number corresponding to a maximum width of the recording medium.

7. A maintenance method for the recording head in the inkjet recording apparatus according to claim 1, the method comprising:

a step of shutting off gas entrance and exit with respect to the inside of the second storage section by using the second switching unit;

a step of shutting off gas entrance and exit with respect to the inside of the first storage section by using the first switching unit;

a step of closing the recovery passage using the third switching unit;

a step of supplying the ink stored in the second storage section to the first storage section by using the supply unit, and ejecting the ink from the plurality of nozzles of the recording head;

a step of opening the recovery passage by using the third switching unit; and a step of supplying ink stored in the second storage section to the first storage section by using the supply unit, and allowing ink inside the recording head to reflow to the second storage section.

8. The inkjet recording apparatus according to claim 1, wherein the control unit opens the gas entrance and exit with respect to the inside of the first storage section by using the first switching unit during formation of an image, and closes the recovery passage using the third switching unit.

9. The inkjet recording apparatus according to claim 1, further comprising:

a plurality of heating units that are individually provided on the recording head, the first storage section and the second storage section, respectively and heat the recording head, the first storage section and the second storage section; and a detection unit that detects a temperature of each of the recording head, the first storage section and the second storage section, wherein the control unit controls the respective operation of the plurality of heating units so that a temperature of each of the recording head, the first storage section and the second storage section becomes temperatures which are respectively set to the recording head, the first storage section and the second storage section based on the detection results obtained by the detection unit, and the setting temperature of the first storage section and the second storage section is higher than the setting temperature of the recording head.

10. The inkjet recording apparatus according to claim 1, further comprising:

a plurality of heating units that are individually provided on the recording head and the supply passage, respectively and heat the recording head and the supply passage; and a detection unit that detects a temperature of each of the recording head and the supply passage, wherein the control unit controls the respective operation of the plurality of heating units so that a temperature of each of the recording head and the supply passage becomes temperatures which are respectively set to the recording head and the supply passage based on the detection results obtained by the detection unit, and the setting temperature of the supply passage is lower than the setting temperature of the recording head.

11. The inkjet recording apparatus according to claim 1, further comprising:

a plurality of heating units that are individually provided on the recovery passage and the supply passage, respectively and heat the recovery passage and the supply passage; and a detection unit that detects a temperature of each of the recovery passage and the supply passage, wherein the control unit controls the respective operation of the plurality of heating units so that a temperature of each of the recovery passage and the supply passage becomes temperatures which are respectively set to the recovery passage and the supply passage based on the detection results obtained by the detection unit, and the setting temperature of the supply passage is higher than the setting temperature of the supply passage.

* * * * *